US010858130B2

(12) United States Patent
Cosaro et al.

(10) Patent No.: US 10,858,130 B2
(45) Date of Patent: Dec. 8, 2020

(54) PACKAGING APPARATUS WITH EVACUATION ASSEMBLY AND PACKAGING PROCESS

(71) Applicant: Cryovac, LLC, Charlotte, NC (US)

(72) Inventors: Lino Cosaro, Gallarate (IT); Giulio Benedetti, Solbiate Arno (IT); Michelangelo Bulgarelli, Rho (IT); Jvanhoe Rizzi, Legnano (IT)

(73) Assignee: Cryovac, LLC, Charlotte, NC (US)

( * ) Notice: Subject to any disclaimer, the term of this patent is extended or adjusted under 35 U.S.C. 154(b) by 207 days.

(21) Appl. No.: 15/554,124

(22) PCT Filed: Feb. 26, 2016

(86) PCT No.: PCT/EP2016/054054

§ 371 (c)(1),
(2) Date: Aug. 29, 2017

(87) PCT Pub. No.: WO2016/135277

PCT Pub. Date: Sep. 1, 2016

(65) Prior Publication Data

US 2018/0072443 A1 Mar. 15, 2018

(30) Foreign Application Priority Data

Feb. 26, 2015 (EP) ..... 15156800

(51) Int. Cl.
*B65B 31/00* (2006.01)
*B65B 31/02* (2006.01)
(Continued)

(52) U.S. Cl.
CPC ..... *B65B 31/02* (2013.01); *B65B 9/06* (2013.01); *B65B 25/001* (2013.01); *B65B 25/06* (2013.01);
(Continued)

(58) Field of Classification Search
CPC ..... B65B 31/02; B65B 9/06; B65B 25/067; B65B 53/063; B29C 66/00145; B29C 66/849; B29C 66/00141
(Continued)

(56) References Cited

U.S. PATENT DOCUMENTS 1,980,022 A 11/1934 Whitehouse
3,420,034 A 1/1969 Saraisky et al.
(Continued)

FOREIGN PATENT DOCUMENTS

EP 0566521 A1 10/1993
EP 1839824 A1 10/2007
(Continued)

OTHER PUBLICATIONS

Written Opinion of the International Searching Authority, International Application No. PCT/EP2016/054054, dated Sep. 1, 2016.

*Primary Examiner* — Chelsea E Stinson
(74) *Attorney, Agent, or Firm* — Jon M. Isaacson

(57) ABSTRACT

A packaging apparatus includes a control unit, a loading station that positions a tubular film around a product to be packaged, a sealing station, a control unit that controls the sealing station to create one or more seals on the tubular film, an evacuation assembly that includes a first member and a second member arranged opposite the first member, and a means for moving the product relative to and from the evacuation assembly. The first member includes a deformable portion. The first and second members are relatively movable between: a first configuration, in which the first and second members are spaced apart from one another, a second configuration, in which the deformable portion contacts at least part of the second member and/or part of the tubular film, and a third configuration in which the deformable portion is compressed in a compression direction towards the second member.

12 Claims, 13 Drawing Sheets

(51) Int. Cl.

| | |
|---|---|
| ***B65B 53/06*** | (2006.01) |
| ***B65B 57/00*** | (2006.01) |
| ***B65B 9/06*** | (2012.01) |
| ***B65B 25/00*** | (2006.01) |
| ***B65B 31/04*** | (2006.01) |
| ***B65B 51/30*** | (2006.01) |
| ***B65B 25/06*** | (2006.01) |

(52) U.S. Cl.
CPC ..... *B65B 25/067* (2013.01); *B65B 31/043* (2013.01); *B65B 51/30* (2013.01); *B65B 51/303* (2013.01); *B65B 53/063* (2013.01); *B65B 57/00* (2013.01)

(58) Field of Classification Search
USPC ..... 52/433
See application file for complete search history.

(56) References Cited

U.S. PATENT DOCUMENTS

| | | | | |
|---|---|---|---|---|
| 3,750,365 | A * | 8/1973 | Darby, Jr. | B65B 43/26 53/459 |
| 3,782,070 | A | 1/1974 | Erlandson | |
| 4,457,122 | A | 7/1984 | Atkins et al. | |
| 4,633,654 | A | 1/1987 | Sato et al. | |
| 4,642,969 | A | 2/1987 | Johnson et al. | |
| 4,964,259 | A | 10/1990 | Ylvisaker et al. | |
| 5,031,386 | A | 7/1991 | Schneider | |
| 5,170,609 | A | 12/1992 | Bullock et al. | |
| 5,237,800 | A | 8/1993 | Omori | |
| 5,400,569 | A | 3/1995 | Jones et al. | |
| 5,447,012 | A | 9/1995 | Kovacs et al. | |
| 5,473,867 | A | 12/1995 | Suga | |
| 5,590,509 | A | 1/1997 | Esteves et al. | |
| 6,029,428 | A | 2/2000 | Terminella et al. | |
| 7,568,326 | B1 | 8/2009 | Terminella et al. | |
| 8,171,703 | B2 | 5/2012 | Arlinghaus | |
| 2014/0123599 | A1 * | 5/2014 | Gustafsson | B65B 9/067 53/405 |
| 2019/0193881 | A1 * | 6/2019 | Pecherskiy | B65B 31/024 |

FOREIGN PATENT DOCUMENTS

| | | | |
|---|---|---|---|
| EP | 2722280 | A1 | 4/2014 |
| GB | 844014 | A | 8/1960 |
| GB | 2104472 | A | 3/1983 |
| GB | 2113646 | A | 8/1983 |
| JP | 2003072702 | A | 3/2003 |
| WO | 0198149 | A1 | 12/2001 |
| WO | 0226562 | A1 | 4/2002 |
| WO | 2014060223 | A1 | 4/2014 |

* cited by examiner

PACKAGING APPARATUS WITH EVACUATION ASSEMBLY AND PACKAGING PROCESS

TECHNICAL FIELD

The present invention relates to a packaging apparatus comprising an evacuation assembly and to a packaging process. The packaging process includes moving a packaged product through an evacuating station where gas or air inside the package is evacuated prior to sealing of the package.

BACKGROUND ART

A packaging apparatus may be used to package a food product. The product may be a product by itself or a product pre-loaded onto a tray. A tube of plastic wrap is continuously fed through a bag/package forming, filling and sealing apparatus. The film and the product are joined or otherwise brought together or placed with respect to one another. For example, the product is deposited on the film or the film is wrapped around the product. In some examples, the product is fed through an infeed belt. A tube is created around the product by sealing opposite longitudinal edges of the film. Alternatively, the product is placed in the tube and a leading edge of the packaging is sealed. Then the tube is sealed at the trailing edge (at the upstream end) of the package and is separated (e.g. cut) from the continuously moving tube of packaging.

The tube may be provided as a tube, or be formed from two films or webs sealed longitudinally at two longitudinal edges, or from a single film that is folded over and sealed along its longitudinal edges.

Sealing bars may be used to seal the package, wherein a lower bar and an upper bar are moved, at least one with respect to the other or both with respect to one another, in order to contact each other, squeezing the packaging material therebetween and providing one or more seals. The sealing bars typically also form an adjacent seal, which comprises the opposite end of a following package, and a cut between the two seals, thereby providing one semi-sealed package (e.g. having an open end, typically the end of the tube fed into the packaging apparatus) and a separate (e.g. cut off) sealed package during a single packaging process step.

The seals are typically transversally extending regions of packaging material that have been processed to provide a seal between the inside of the packaging and the environment. Gas or air may be trapped in the package in the space between the product and the film after sealing both ends. A common problem in a packaging process is to achieve a desired reduction of the amount of gas or air in a package prior to sealing the package.

It is sometimes desirable to evacuate the package so as to reduce the package volume. Additionally, evacuation of the gas from the package may improve packaging appearance after heat shrinking and may also reduce the possibility of deterioration of the product due to exposure to oxygen or other gas(es). For example, some food products (e.g. cheese) may oxidize or develop mold over a period of time if an unsuitable atmosphere (e.g. containing oxygen) is contained within the package. A suitable atmosphere may essentially consist of or comprise one or more protective gases, and/or inert gases, or essentially consist of or comprise a modified atmosphere. Modified atmosphere packaging (MAP) typically comprises reducing the amount of oxygen ($O_2$) inside a package, for example, from approximately 21% to about 10%, preferably to about 5%, more preferably to about 0%. This can substantially reduce or prevent growth of aerobic organisms and/or oxidation reactions. Oxygen thus removed may be replaced with an inert gas, for example nitrogen ($N_2$), or with a gas that can lower the pH or inhibit the growth of bacteria, for example carbon dioxide ($CO_2$). It is noted that any gas or mixture of gases commonly known in packaging can be used. Carbon monoxide can be used for preserving the red color of meat.

One way of evacuating a package is to puncture or perforate the package with small holes before or after the goods are sealed therein. The small holes allow the excess gas within the package to be expelled, for example by mechanical application of force or simply by the force of gravity settling the products during shipment, or, preferably, by heat shrinking the packaging material. However, this particular solution to the problem has disadvantages, for example when foods are contained within the package. The pinholes allow the ingress of contaminants or environmental air from outside the package, for example containing oxygen. The pinholes may be covered during or after packaging in suitable ways, for example, by applying stickers.

Another way of deflating packages is to evacuate the inside of the package or container through the fill opening using a vacuum process. A vacuum (or volume of significantly lower pressure than ambient pressure) is generated and applied in order to extract excess gas or air from inside the package. In this manner, the packaging material (e.g. film) is collapsed prior to sealing the opening. However, the use of a vacuum system may increase the complexity of the packaging apparatus and/or have negative effects on the time required for the packaging process, due to the time required for applying the vacuum to the package through its opening.

Further, vacuum systems often require the installation of equipment within the fill tube to close the tube off from the environment. Such additional equipment may reduce the tube diameter, which may cause plugging due to product bridging. Further, the additional equipment renders the apparatus and its operation more complex and expensive. Alternatively, the process may require packages to be evacuated to be brought into a vacuum chamber, necessitating also additional equipment and/or further processing steps with similar effects on cost and complexity.

A further way of deflating packages is to provide mechanical force directly to the outside of the package before the sealing takes place. Examples of this are sponge rubber or coiled springs which engage the outside of the package to expel excess gas prior to the time the sealing jaws engage and seal the fill opening.

However, the surfaces of a product within the package are often irregular and, thus, tend to cause uneven wear of the foam rubber and uneven elongation of the springs. As a result of the uneven wear and deterioration from the close proximity to the heated sealing elements, the long term manufacturing standards may not be maintained at a desired level. Additionally, fragile products are easily crushed by exterior mechanical applications of force. Additional drawbacks of using mechanical force via sponge rubber may include poor hygiene due to difficulties of cleaning porous material such as sponges, thereby providing ideal media for bacterial growth. Further, the sponge or coils may push the film into contact with the product thereby changing the appearance of the product. For example, in the case of meat, blood may soil the interior of the film.

Further, variations of the product size may cause problems for mechanical deflators. When using mechanical deflators, correction of these variations requires a shutdown of the machine to modify the deflation force or position. This is because it is necessary to provide different pressure pads individually shaped for the packages and products to be processed.

U.S. Pat. No. 4,964,259 discloses a process and apparatus for forming, filling, sealing and deflating a package of goods prior to the time the fill opening is sealed. The system includes a blast of air against the exterior flexible sidewalls of the package thereby to bring the sidewalls of the package closer together before sealing, thereby to reduce the amount of trapped gas sealed in the package.

JP 2003-072702 discloses a bag-packing machine having a chamber. By the pressure of compressed air supplied into the chamber through an air hose, a bag is pressed to push out the air in the bag through the back edge, which is open.

DE 10 2009 017 993 discloses a packaging apparatus comprising a perforation unit which is configured to perforate the lower film in order to facilitate evaporation of gas, for example ethylene or $CO_2$, when packaging products that generate such gas during ripening. Also, such products may require a constant oxygen content while being packaged.

DE 10 2007 013 698 discloses a packaging apparatus comprising a means for providing a controlled atmosphere inside a package depending on a breathing property of the package product.

WO 2008/122680 discloses a packaging machine based on applying mechanical force to a film arranged around a product to be packaged by means of a tamper device and further on shrink-wrapping the film around the product by means of an oven device. Excess air or gas is expelled both by means of the tamper device and by means of shrink-wrapping.

U.S. Pat. No. 5,590,509 discloses a process for packaging a product on a receptacle. The process includes blowing air heated to a temperature suitable for heat-shrinking the film onto an outer surface of the forward sealed end region of a tubing to pre-shrink the tubing and to expel gas. The process further includes stopping the heat shrinking before the film contacts the product by supplying a cold flow of air.

An aim of the present invention is to provide an evacuation assembly for a packaging process in which excess gas or air is expelled from a package before sealing. Another aim of the present invention is to provide a packaging apparatus comprising the evacuation assembly. Another aim of the present invention is to provide an evacuation assembly that facilitates efficient evacuation of packages of different sizes.

SUMMARY OF INVENTION

According to the invention, in a $1^{st}$ aspect there is provided a packaging apparatus comprising a control unit, a loading station configured to position a tubular film around a product to be packaged, a sealing station coupled to the control unit, the control unit being configured to control the sealing station to create one or more seals on the tubular film, an evacuation assembly coupled to the control unit, the evacuation assembly including a first member and a second member arranged opposite the first member, the first member including a deformable portion, the first and second members being relatively movable between a first configuration, in which the first and second members are spaced apart from one another, a second configuration, in which the deformable portion contacts at least part of the second member and/or part of the tubular film which in use is resting against the second member, and a third configuration in which the deformable portion is compressed in a compression direction towards the second member; and a means for moving the product relative to and from the evacuation assembly.

In a $2^{nd}$ aspect according to the $1^{st}$ aspect, the deformable portion delimits a chamber having an opening towards the second member.

In a $3^{rd}$ aspect according to the $2^{nd}$ aspect, when the first and second members are in the second or third configuration, the chamber is closed against the second member and defines a working portion on the second member, the perimeter of which is configured to encompass a product positioned in a package and placed in correspondence of the working portion.

In a $4^{th}$ aspect according to aspect 2 or 3, the first member comprises a holder portion, the deformable portion being coupled to the holder portion and facing the second member.

In a $5^{th}$ aspect according to the $4^{th}$ aspect the deformable portion extends along a perimeter of the holder portion.

In a $6^{th}$ aspect according to any one of aspects 2 to 5, when the first and second members are in the second configuration, the holder portion and the second member are positioned at a first distance from one another, providing the chamber with a first volume; and when the first and second members are in the third configuration, the holder portion and the second member are positioned at a second distance, smaller than the first distance, from one another, providing the chamber with a second volume smaller than the first volume.

In a $7^{th}$ aspect according to the $6^{th}$ aspect, the first distance ranges from 100 mm to 500 mm, preferably from 160 mm to 300 mm; and/or the second distance ranges from 50 mm to 250 mm, preferably from 80 mm to 150 mm; and/or the second volume ranges from 6 liters to 30 liters.

In an $8^{th}$ aspect according to any one of aspects 1 to 7, the deformable portion comprises a deformable region, the deformable region having a bellows-type structure extending circumferentially along the second portion, optionally the deformable region comprising one or more of rubber, fabric, cardboard, composite material including rubber and fabric and/or cardboard, deformable plastic, LLDPE, PLA, PA, and LLDPE, PLA, PA including an additive, the additive optionally being rubber.

In a $9^{th}$ aspect according to any one of aspects 1 to 8, the deformable portion comprises an outer portion and an inner portion, optionally the outer and/or inner portions having the form of a layer of film material.

In a $10^{th}$ aspect according to the $9^{th}$ aspect, the inner portion is at least partially permeable to air or gas and comprises a compliant material, optionally the compliant material being selected from foam material, closed or semi-closed cell foamed PU, and Silicon foam.

In an $11^{th}$ aspect according to any one of aspects 9 or 10, the outer layer is substantially impermeable to air or gas and comprises a compliant material, in particular select from single or multilayer film material, optionally comprising LDPE, PA, PVC, and/or Silicon.

In a $12^{th}$ aspect according to any one of aspects 9 to 11, the inner portion consist entirely of an alveolar, optionally foam material, preferably closed or semi-closed cell foamed PU or Silicon foam, and the outer portion consist entirely of a plastic film impermeable to air or gas.

In a $13^{th}$ aspect according to any one of aspects 9 to 12, the outer portion comprises one or more flow regulators, the one or more flow regulators being configured to allow the passage of air or gas, optionally the one or more flow regulators being configured to allow the passage of air or gas when a pressure differential between opposite sides of the outer portion reaches or exceeds a pre-determined maximum value, optionally the maximum value ranging from 1 kPa to 50 kPa (0.01 bar to 0.50 bar), preferably from 5 kPa to 20 kPa (0.05 bar to 0.20 bar), more preferably from 10 kPa to 15 kPa (0.10 bar to 0.15 bar).

In a 14$^{th}$ aspect according to any one of aspects 1 to 13, the compression direction is substantially perpendicular to a working surface of the second member facing the first member.

In a 15$^{th}$ aspect according to any one of aspects 1 to 14, the packaging apparatus further comprises an output station, the control unit being coupled to the output station and configured to control an output of one or more sealed packages from the packaging apparatus; and/or a flusher, the control unit being coupled to the flusher and configured to control the flusher to provide the inside of the tubular film and/or the inside of a semi-sealed package with one of an inert gas, a mixture of inert gases, or a modified atmosphere; and/or a shrink station, the control unit being coupled to the shrink station and configured to control the shrink station to heat-shrink one or more sealed packages.

In a 16$^{th}$ aspect according to any one of aspects 1 to 15, the head consists of a first part and a second part, at least one of the first and second parts being relatively movable with respect to the other, optionally along an adjustment direction extending substantially parallel to a motion direction of products along the packaging machine.

In a 17$^{th}$ aspect according to the 16$^{th}$ aspect, the first part and the second part are configured to slidably engage one another, thereby allowing the relative movement to adjust a size of the head.

In a 18$^{th}$ aspect according to any one of aspects 16 or 17 and aspect 3, the relative movement of the first part and the second part determines the size of the working portion.

In a 19$^{th}$ aspect according to any one of aspects 1 to 18, the packaging apparatus further comprises an actuator coupled to the control unit and configured to relatively move the first and/or second members into the first, second, and third configurations.

In a 20$^{th}$ aspect according to the 19$^{th}$ aspect, the actuator is configured to relatively move the first and/or second members into the first, second, and third configurations in accordance with a pre-determined respective profile defining one or more of the following parameters: a rate of relative movement over time from 0.5 m/s to 2.0 m/s, preferably from 0.7 m/s to 1.5 m/s more preferably from 1.0 m/s to 1.2 m/s; a minimum and/or maximum retention time from 0.05 s to 1.0 s, more preferably from 0.1 s and 0.7 s, even more preferably from 0.1 s to 0.3 s, for any one of the first, second, and third configurations; and an actuation force applied to the first and/or second members when relatively moving the first and/or second members into the second or third configuration, the actuation force ranging from 5 N to 400 N, preferably from 20 N to 200 N.

In a 21$^{st}$ aspect according to any one of aspects 1 to 20, the means for moving are configured to move products along a motion direction along the packaging machine, optionally the means for moving being configured to move products along the motion direction substantially continuously and/or without stopping.

In a 22$^{nd}$ aspect according to the 21$^{st}$ aspect, the first and second members are configured for accommodating, when in the second and third configurations, a translatory motion corresponding to the motion direction.

In a 23$^{rd}$ aspect according to any one of aspects 21 or 22, the sealing station is configured for accommodating a translatory motion corresponding to the motion direction.

In a 24$^{th}$ aspect, there is provided a packaging process comprising providing a semi-sealed package containing a product to be packaged, the semi-sealed package being made from a tubular film and having a first sealed end and a second open end; providing an evacuation assembly including a first member and a second member arranged opposite the first member, the first member comprising a deformable portion, wherein the first and second members are relatively movable between: a first configuration, in which the first and second members are spaced apart from one another, a second configuration, in which the deformable portion contacts at least part of the second member and/or part of the tubular film which in use is resting against the second member, and a third configuration in which the deformable portion is compressed in a compression direction towards the second member, wherein the deformable portion defines, when in the second or third configuration, a working portion on the second member, the perimeter of which is configured to encompass the product positioned in the semi-sealed package and placed in correspondence of the working portion; relatively moving the first and/or second members into the first configuration; relatively positioning the semi-sealed package and the evacuation assembly such that the first sealed end and the product are positioned within the working portion and the second open end extends beyond the working portion, relatively moving the first and/or second members into the second configuration where the deformable portion contacts the film at an intermediate portion of the second open end resting against the second member, and relatively moving the first and/or second members into the third configuration by compressing the deformable portion and determining a gas flow from inside the semi-sealed package out of the second open end; and sealing the semi-sealed package at the second open end, thereby forming a sealed package containing the product and having first and second sealed ends.

In a 25$^{th}$ aspect according to the 24$^{th}$ aspect, the deformable portion delimits a chamber having an opening towards the second member, and optionally wherein relatively moving the first and/or second members into the first configuration comprises opening the chamber or keeping it open.

In a 26$^{th}$ aspect according to any one of aspects 24 to 25, relatively moving the first and/or second members into the second or third configuration comprises closing the chamber or keeping it closed against the second member and defining the working portion on the second member, the perimeter of which being configured to encompass the product positioned in the semi-sealed package and placed in correspondence of the working portion.

In a 27$^{th}$ aspect according to any one of aspects 24 to 26, the first member comprises a holder portion, the deformable portion being coupled to the holder portion and facing the second member.

In a 28$^{th}$ aspect according to the 27$^{th}$ aspect, the deformable portion extends along a perimeter of the holder portion.

In a 29$^{th}$ aspect according to any one of aspects 25 to 28, relatively moving the first and/or second members into the second configuration comprises relatively positioning the holder portion and the second member at a first distance from one another, thereby providing the chamber with a first volume; and wherein relatively moving the first and/or second members into the third configuration comprises relatively positioning the holder portion and the second member at a second distance, smaller than the first distance, from one another, thereby providing the chamber with a second volume smaller than the first volume.

In a 30$^{th}$ aspect according to the 29$^{th}$ aspect, the first distance ranges from 100 mm to 500 mm, preferably from 160 mm to 300 mm; and/or the second distance ranges from 50 mm to 250 mm, preferably from 80 mm to 150 mm; and/or the second volume ranges from 6 liters to 30 liters.

In a 31$^{st}$ aspect according to any one of aspects 24 to 30, the deformable portion comprises a deformable region, the deformable region having a bellows-type structure extending circumferentially along the second portion, optionally the deformable region comprising one or more of rubber, fabric, cardboard, composite material including rubber and fabric and/or cardboard, deformable or rigid plastic, LLDPE, PLA, PA, Teflon; and LLDPE, PLA, PA including an additive, the additive optionally being rubber.

In a 32$^{nd}$ aspect according to any one of aspects 24 to 30, the deformable portion comprises an outer portion and an inner portion, optionally the outer and/or inner portions having the form of a layer of film material.

In a 33$^{rd}$ aspect according to the 32$^{nd}$ aspect, the inner portion is at least partially permeable to air or gas and comprises a compliant material, optionally the compliant material being selected from foam material, closed or semi-closed cell foamed PU, and Silicon foam.

In a 34$^{th}$ aspect according to any one of aspects 32 to 33, the outer layer is substantially impermeable to air or gas and comprises a compliant material, in particular select from single or multilayer film material, optionally comprising LDPE, PA, PVC, and/or Silicon.

In a 35$^{th}$ aspect according to any one of aspects 32 to 34, the inner portion consist entirely of an alveolar, optionally foam material, preferably closed or semi-closed cell foamed PU or Silicon foam, and the outer portion consist entirely of a plastic film impermeable to air or gas.

In a 36$^{th}$ aspect according to any one of aspects 32 to 35, the outer portion comprises one or more flow regulators, the one or more flow regulators being configured to allow the passage of air or gas, optionally the one or more flow regulators being configured to allow the passage of air or gas when a pressure differential between opposite sides of the outer portion reaches or exceeds a pre-determined maximum value, optionally the maximum value ranging from 1 kPa to 50 kPa (0.01 bar to 0.50 bar), preferably from 5 kPa to 20 kPa (0.05 bar to 0.20 bar), more preferably from 10 kPa to 15 kPa (0.10 bar to 0.15 bar).

In a 37$^{th}$ aspect according to any one of aspects 24 to 36, the compression direction is substantially perpendicular to a working surface of the second member facing the first member.

In a 38$^{th}$ aspect according to any one of aspects 24 to 30, the packaging process further comprises providing a flusher and controlling the flusher to provide the inside of the tubular film and/or the inside of the semi-sealed package with one of an inert gas, a mixture of inert gases, or a modified atmosphere; and/or providing a shrink station controlling the shrink station to heat-shrink the sealed package.

In a 39$^{th}$ aspect according to any one of aspects 29 to 38, determining the gas flow from inside the semi-sealed package out of the second open end comprises creating an increase in pressure within the chamber corresponding to a ratio between the first and second volumes.

In a 40$^{th}$ aspect according to any one of aspects 24 to 39, relatively moving the first and/or second members into the first, second, and third configurations is performed in accordance with a pre-determined respective profile defining one or more of the following parameters: a rate of relative movement over time from 0.5 m/s to 2.0 m/s, preferably from 0.7 m/s to 1.5 m/s more preferably from 1.0 m/s to 1.2 m/s; a minimum and/or maximum retention time from 0.05 s to 1.0 s, more preferably from 0.1 s and 0.7 s, even more preferably from 0.1 s to 0.3 s, for any one of the first, second, and third configurations; and an actuation force applied to the first and/or second members when relatively moving the first and/or second members into the second or third configuration, the actuation force ranging from 5 N to 400 N, preferably from 20 N to 200 N.

In a 41$^{st}$ aspect according to any one of aspects 24 to 40, the first member consists of a first part and a second part, and the packaging process further comprises relatively moving at least one of the first and second parts with respect to the other, optionally along an adjustment direction extending substantially parallel to a motion direction of products along the packaging machine.

In a 42$^{nd}$ aspect according to the 41$^{st}$ aspect, the first part and the second part are configured to slidably engage one another, and the packaging process further comprises relatively moving at least one of the first and second parts with respect to the other to adjust a size of the first member.

In a 43$^{rd}$ aspect according to any one of aspects 41 or 42, the packaging process further comprises relatively moving at least one of the first part and the second part in order to determine the size of the working portion.

In a 44$^{th}$ aspect according to any one of aspects 24 to 43, the packaging process further comprises controlling an actuator to relatively move the first and/or second members into the first, second, and third configurations.

Advantages of the packaging apparatus comprising the evacuation assembly, and the packaging process include overcoming the limitations described above. In particular, the apparatus and process facilitate simple and efficient evacuation of packages because complex components, for example vacuum pumps, can be eliminated from the packaging apparatus. Further advantages include a more robust, reliable, and durable packaging process and apparatus, as the evacuation does not necessitate contact between, for example, a sponge or spring component with the package and/or product. This also reduces wear and tear. Moreover, in cases where identical products are packaged, it is not necessary to provide a sponge/spring component exactly shaped to fit the product. And in cases where non-identical products are packaged (e.g. natural products like poultry, vegetables, fruit, etc.), providing a sponge/spring element exactly shaped to fit the product is not feasible due to variations in the product. Further advantages include more flexibility with respect to product sizes and/or tube diameters. The components can be easily adapted, adjusted, or exchanged and tube diameter, typically limited due to requirements imposed by a vacuum system, is not restricted in the same manner. Further advantages are described in more detail below.

DETAILED DESCRIPTION

Figure 1:
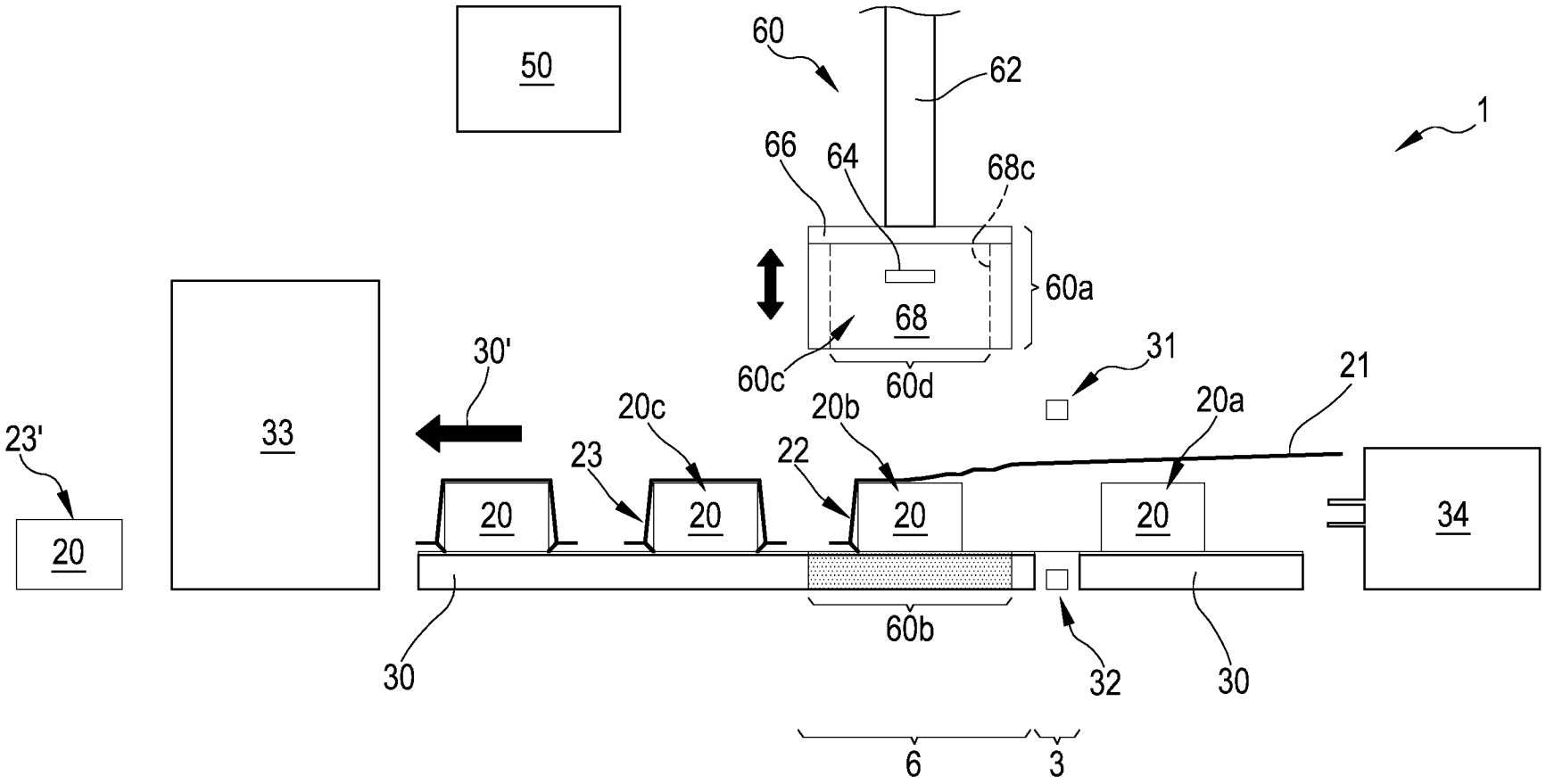
FIG. 1 schematically shows a packaging apparatus 1 in accordance with a first embodiment of the present invention comprising an evacuation assembly located at an evacuating station.

FIG. 1 schematically shows a packaging apparatus 1 in accordance with a first embodiment of the present invention comprising an evacuation assembly 60 located at an evacuating station 6. In general, the packaging apparatus 1 comprises a loading station (not shown), a sealing station 3, an evacuating station 6, and means for moving 30. At the loading station, products 20 are placed into a tubular film 21 or the film is placed around products 20 and continuously sealed along its edges in order to form the tubular film 21 in a manner known in the art. The means for moving 30 are configured to move products 20 situated inside film 21 from the loading station towards and through the sealing station 3 and to the evacuating station 6.

The products 20 to be packaged may assume different states (20*a*, 20*b*, 20*c*) of being packaged. States 20*a*, 20*b*, 20*c* denote product 20 being in different packaging states. For example, state 20*a* denotes product 20 positioned inside tubular film 21. State 20*b* denotes product 20 positioned in a semi-sealed package 22, wherein the semi-sealed package 22 has a first end, downstream in terms of a motion direction 30' of products 20 along packaging machine 1, which is sealed, and a second (upstream) end, which is open. State 20*c* denotes product 20 positioned in a sealed package 23 having first and second sealed ends (i.e. wherein both the upstream and the downstream end of the package are sealed).

In state 20*a*, a film 21 is positioned around product 20 or product 20 is positioned in a tubular film 21. Alternatively, in state 20*a* product 20 is positioned on film 21, which is subsequently folded over and sealed at its longitudinal edges in order to form a tubular film 21. This may be carried out at the loading station.

The sealing station 3 comprises an upper sealing and cutting member 31 and a lower sealing and cutting member 32 configured to seal and cut the packaging, i.e. the material of film 21. Sealing and cutting members 31 and 32 are configured to create a first seal on film 21, thereby creating the semi-sealed package 22 containing product 20 in state 20*b* and having a first sealed end at the downstream end of semi-sealed package 22. Product 20 in state 20*b* is situated inside film 21 and semi-sealed package 22 comprises a sealed end and an open end.

Sealing and cutting members 31 and 32 are further configured to create a second seal on film 21, thereby creating a sealed package 23. In state 20*c*, product 20 is situated inside film 21 and sealed package 23 comprises a first sealed end and a second sealed end at both the upstream and downstream ends thereof.

Sealing and cutting members 31 and 32 may be configured to create both seals at once. For example, sealing and cutting members 31 and 32 may create the second seal of a first product 20 and the first seal of a second product 20, located upstream with respect to the first product 20 and a moving direction of products 20 along packaging apparatus 1, at substantially the same time, so that subsequently the first product 20 is contained in a sealed package 23 and the second product 20 is contained in a semi-sealed package 22. FIG. 1 shows two products 20 (see states 20*c* and 20*b*, where—after the simultaneous creation of the first and second seals—product 20 in state 20*b* has already been moved from the sealing station 3 towards and into evacuating station 6, and where product 20 in state 20*c* has already been moved out of evacuating station 6 towards a position downstream thereof.

For sealing and/or cutting, the sealing and cutting members 31 and 32 are brought from a first configuration, in which the members 31 and 32 are spaced apart from one another, into a second configuration, in which the members 31 and 32 are substantially in contact with one another.

In order to facilitate sealing and/or cutting film 21, sealing and cutting members 31 and 32 are arranged so that film 21 is interposed between members 31 and 32. Members 31 and 32 may have active or working surfaces that are configured to face film 21 and each other in a manner that film 21 is, in the second configuration of members 31 and 32, substantially in contact with both working surfaces. Further, where no film 21 is interposed between members 31 and 32, members 31 and 32 are substantially in contact with each other, wherein contact may be made by means of the active or working surfaces of both members 31 and 32.

Sealing and cutting members 31 and 32 may further be configured to form a transversal seal in the packaging. A transversal seal denotes a seal oriented substantially transversal to a longitudinal extension of film 21 and to the direction of movement of the products. In the case of the packaging being supplied from a roll of film 21, the sealing and cutting members 31 and 32 may form a transversal seal across the tube of film 21, substantially perpendicular to the length of film 21.

Generally, the means for moving 30 are configured to move products in a main moving direction 30' along packaging apparatus 1. Means for moving 30 may comprise one or more conveyor belts know in the art, for example an infeed belt (see reference numeral 30 on the right hand side of FIG. 1) and an exit belt (see reference numeral 30 on the left hand side of FIG. 1). For clarity, the one or more conveyor belts are jointly referred to as moving means 30, irrespective of their individual position.

Evacuating station 6 includes evacuation assembly 60, which comprises a head 60*a* (e.g. a first member) and a support 60*b* (e.g. a second member) arranged opposite one another. Head 60*a* comprises a first portion 66 (below also denoted as "holder") configured to carry a second portion 68 (below also denoted as "apron"), wherein the second portion 68 extends along a perimeter of the first portion 66, thereby defining a chamber 60*c* delimited by an inner wall 68*c* of the second portion 68. Chamber 60*c* has an opening 60*d* at the bottom thereof, towards support 60*b*.

Support 60*b* may consist of a separate component (e.g. a separate conveyor belt or other means for moving) or consist of a portion of means for moving 30, as shown in FIG. 1 (see portion marked by reference numeral 60*b* in FIG. 1, which is a portion of means for moving 30). In the embodiment shown in FIG. 1, support 60*b* corresponds to a portion of means for moving 30 below head 60*a* and, from an above point of view, in superimposition therewith, such that upon establishing contact between head 60*a* and means for moving 30, support 60*b* (i.e. the portion of means for moving 30 in superimposition with head 60*a*) contacts apron 68 along a perimeter thereof and substantially closes chamber 60*c* by covering opening 60*d*.

In the embodiment shown, head 60*a* is carried by actuator 62 which provides head 60*a* with a vertical movement towards support 60*b* and away therefrom. In general, it is noted that either head 60*a* is movable with respect to support 60*b* (as shown in FIG. 1) or that support 60*b* is movable with respect to head 60*a*, or that both head 60*a* and support 60*b* are movable with respect to one another, in order to allow for opening 60*d* to be covered by support 60*b* due to the relative motion created. Generally, in all embodiments, including any one of the first, second, third, and fourth embodiments, head 60*a* can alternatively be coupled to one or more actuators (not shown) of the sealing station. In this variant, no separate actuator 62 is required (e.g. for separately actuating the head 60*a* and/or support 60*b*) but instead relative motion is imparted using an existing actuator acting on one or more of sealing bars 31 and 32. In some of these embodiments, head 60*a* is coupled to sealing bar 31 by a coupling means (e.g. a piston/cylinder, lever, rail, deformation element or similar) so that relative motion between head 60*a* and sealing bar 31 is allowed. This configuration allows for the following motion steps: a corresponding joint actuator moves sealing bar 31 and head 60*a* respectively towards sealing bar 32 and support 60*b*; the joint actuator brings head 60*a* and support 60*b* into contact while sealing bars 31 and 32 are still in a spaced apart configuration; the coupling means compensates the continuing movement of the sealing bar 31 towards sealing bar 32, while head 60*a* is pushed and/or compressed against support 60*b* (e.g. thereby allowing for relative motion between head 60*a* and sealing bar 31); and the joint actuator brings sealing bars 31 and 32 into contact with one another while head 60*a* is held pushed and/or compressed against support 60*b*. Subsequently (e.g. after sealing has been performed by sealing bars 31 and 32), the joint actuator performs a motion in the opposite direction, thereby separating the sealing bars 31 and 32, reducing the compression of head 60*a* against support 60*b* and separating head 60*a* and support 60*b*, thereby returning to its initial configuration.

Sealing station 3 and evacuation assembly 6 are further configured to support translatory motion along the main moving direction 30' of products 20 along packaging apparatus 1. This means that both sealing station 3 and evacuation assembly 6, jointly or independently, can follow the main moving direction 30' as long as sealing and/or evacuation takes place. In case of sealing station 3, sealing bars 31 and 32 can be configured to allow the translatory motion during the time it takes to create a seal on the tubular film 21. In detail, sealing bars 31 and 32 are brought into contact with one another, while the tubular film 21 containing the products 20 is continuously moving along the main moving direction 30'. While sealing bars 31 and 32 are in contact, sealing the film, both sealing bars 31 and 32 move together with the packages 22, 23 and the tubular film 21 along the main movement direction 30'. Upon creation of the seal, sealing bars 31 and 32 release contact and, thus, the tubular film 21, and return to their spaced-apart configuration, i.e. primarily vertically, but also longitudinally, thereby going back on the translatory movement performed while sealing.

Substantially the same applies to evacuation assembly 6, where head 60*a* is brought into contact with support 60*b*, which is a corresponding counter surface of means for moving 30. Head 60*a* can be configured to allow the translatory motion during the time it takes to evacuate a semi-sealed package 23. In detail, head 60*a* is brought into contact with support 60*b*, while the tubular film 21 containing the products 20 and resting against support 60*b* is continuously moving along the main moving direction 30'. Here, support 60*b*, being a portion of an upper surface of means for moving 30, continuously moves along the main movement direction 30'. While head 60*a* and support 60*b* are in contact, evacuating the package, both head 60*a* and support 60*b* move together with the packages 22, 23 and the tubular film 21 along the main movement direction 30'. Upon the package being evacuated, head 60*a* and support 60*b* release contact and, thus, the tubular film 21, and return to their spaced-apart configuration, i.e. primarily vertically, but also longitudinally, thereby going back on the translatory movement performed while the evacuation took place.

Apron 68 of head 60*a* may comprise a compliant material or structure (e.g. foam, bellows) such as to facilitate deformation of apron 68 upon establishing contact between apron 68 and support 60*b*. The side wall of chamber 60*c* may entirely be defined by the apron 68 and particularly by the inside surface of the apron. For example, the apron may entirely be made in a deformable material or deformable structure (e.g., foam or bellows as described herein below), or a part of the apron such at least 30% or from 30% to 50% of the vertical extension of the apron may be made in deformable material (e.g., foam or bellows as disclosed herein below). Within the scope of this document, establishing contact means at least part of one element directly contacting another element (e.g. making physical contact). Establishing contact, however, also includes other parts of the two elements being in very close proximity to each other, possibly separated only by one or more layers of a plastic film (e.g. film 21), so that the film may be interposed between the two elements (e.g. partly covering the contact surface or surfaces). With respect to the above, two opposing layers of tubular film 21 extending along packaging apparatus 1 and into evacuating station 6 may be interposed between apron 68 of head 60*a* and support 60*b* along part of the perimeter of apron 68, thereby providing a channel for fluid (e.g. gas, air) flow between and through the tubular film without compromising a substantially sealed contact between apron 68 and support 60*b*. Ensuring substantially sealed contact with support 60*b* along the perimeter of apron 68 may be achieved by apron 68 comprising a compliant material or structure.

Head 60*a* may further comprise one or more flow regulators 64 (e.g. opening, valve) providing for desired fluid flow (e.g. gas, air) between chamber 60*c* and the ambient atmosphere. In FIG. 1, a flow regulator 64 is shown as a rectangular-shaped region in apron 68. Flow regulator 64 may have any suitable shape (e.g. a region comprising a plurality of perforation holes, suitably sized and distributed for a desired permeability; one or more openings of suitable size and shape, for example round, elliptic, rectangular; or any other suitable shape or conformation). Flow regulator 64 may further comprise a suitable composition different from the remainder of apron 68. For example, if apron 68 comprises one or more layers of material, flow regulator may comprise fewer layers of material or individual layers of different material. In one example, apron 68 generally comprises an inner layer substantially consisting of a non-airtight foam material and an outer layer substantially consisting of an airtight plastic film material. In this example, flow regulator 64 may consist of one or more openings in the outer layer having a suitable size and shape (e.g. one of more rectangular openings 64 in apron 68 as shown in FIG. 1), thus facilitating the passage of air/gas from chamber 60*c* through flow openings 64 consisting of non-airtight foam material.

Packaging apparatus 1 further comprises a control unit 50. The control unit is connected (individual connections are not shown in the figures for reasons of clarity) to one or more components of the packaging apparatus 1, for example the loading station, sealing station 3, sealing and cutting members 31 and 32, means for moving 30, evacuating station 6, shrink tunnel 33, and flusher 34. Hot air or shrink tunnel 33 may be provided in order to shrink film 21 of packages 23. Flusher 34 may be provided in order to flush the inside of the packaging film 21 with a protective gas or a protective mixture of gases. For reasons of clarity, the figures generally do not show individual connection lines between the control unit 50 and other components. It is noted that the packaging apparatus 1 may comprise common connection means for connecting control unit 50 to other components, for example electrical, optical, or other connections and/or leads.

Control unit 50 may be configured to control the transport of products 20 along a predefined path, e.g. by controlling one or more (e.g. electrical) motors comprised in means for moving 30 in a step-by-step motion or in a continuous motion. The control unit may also control individual actuators of different components as described below, for example, in order to create transverse seals on the tubular film at sealing station 3 by individually controlling actuators connected to sealing bars 31 and/or 32, as well as by controlling sealing bars 31 and/or 32 directly (e.g. heating units comprised therein).

Control unit 50 may comprise a digital processor (CPU) with memory (or memories), an analogical type circuit, or a combination of one or more digital processing units with one or more analogical processing circuits. In the present description and in the claims it is indicated that the control unit is "configured" or "programmed" to execute certain steps. This may be achieved in practice by any means, which allow for configuring or programming the control unit. For instance, in case of a control unit comprising one or more CPUs, one or more programs are stored in an appropriate memory. The program or programs contain instructions, which, when executed by the control unit, cause the control unit to execute the steps described and/or claimed in connection with the control unit. Alternatively, if the control unit is of an analogical type, then the circuitry of the control unit is designed to include circuitry configured, in use, to process electric signals such as to execute the control unit steps herein disclosed.

Control unit 50 may be connected to one or more components comprised in evacuating station 6 (e.g. actuator 62) and be configured to send and/or receive control signals to/from evacuating station 6. Control unit 50 may further be configured to control actuator 62 in order to move head 60*a* of evacuation assembly 60 relative to support 60*b* (or vice versa), such that chamber 60*c* may be opened, closed, and modified in its internal volume due to relative movement between head 60*a* and/or support 60*b*. In one example, as shown in FIG. 1, actuator 62 may cause head 60*a* to approach support 60*b* from a spaced-apart position and make contact between portion 68 and support 60*b*. Further, actuator 62 may cause holder 66 to further approach support 60*b* and thereby compress portion 68, thus decreasing the internal volume of chamber 60*c* (which is delimited by both holder 66 and support 60*b*, as well as by portion 68 extending circumferentially around chamber 60*c*). The material and/or structure of portion 68 may be suitably compressible or otherwise compliant. For example, portion 68 may be made of an elastic material (e.g. foam, rubber) or structurally yielding (e.g. having the form of a bellows or a shutter having mutually engaging elements). In some embodiments, portion 68 comprises a compliant material, for example foam material, closed or semi-closed cell foamed PU, or Silicon foam. In these embodiments, portion 68 typically further comprises another compliant material substantially impermeable to air or gas such as single or multilayer film material, for example comprising LDPE, PA, PVC, and/or Silicon. In other embodiments, for example in which at least part of portion 68 has a bellows-type structure, portion 68 comprises one or more of rubber, fabric, cardboard, composite material including rubber and fabric and/or cardboard, deformable plastic, LLDPE, PLA, or PA, and LLDPE, PLA, or PA including an additive, for example rubber.

In some embodiments, including any one of the first, second, third, and fourth embodiments, portion 68 comprises at least two different materials. For example, portion 68 can comprise a more rigid material (e.g. cardboard, fabric) in an upper region thereof and a more compliant material (e.g. rubber, silicon) in a lower region thereof. In one example, an upper half of portion 68 comprises cardboard and a lower half comprises silicon. In another example, portion 68 comprises a more rigid material in an upper and a lower region thereof and a more compliant material in an intermediate region (i.e. between the upper and lower regions) thereof. Using a plurality of materials for portion 68 can entail the advantage that the overall stability and/or stiffness of portion 68 can be modified without compromising the ability of portion 68 to be compressible. To this aim, a distribution, arrangement, overlap, composite structure, and/or other combination of two or more materials may be selected accordingly.

Control unit 50 may be configured to control means for moving 30 and/or individual components thereof (e.g. an infeed belt, an exit belt). For example, control unit 50 may be configured to increase and decrease an operating speed of means for moving 30. Control unit 50 may further be configured to control the operating speed of means for moving 30 depending on a position of products 20 with respect different components of packaging apparatus 1. For example, control unit 50 may be configured to control an operating speed of means for moving 30 such that individual products 20 positioned in respective semi-sealed or sealed packages are positioned relative to evacuating station 6, such that semi-sealed package 22 is positioned directly in correspondence of opening 60*d* of chamber 60*c* of head 60*a* of evacuation assembly 60, and/or such that products 20 are positioned relative to members 31 and 32 of sealing station 3 in order to create respective seals on the adjacent package(s).

In particular, in another aspect, the control unit 50 may be configured to control one or more components depending on signals sent to and/or received from other components. For example, the control unit 50 may be configured to control an activation of one or more components depending on the position of products 20 and/or tubular film 21 with respect to other components of packaging apparatus 1. This way, the control unit 50 may activate, for example, the sealing and cutting members 31 and 32 when one product 20 is in state 20*a* and another product 20 is in state 20*b* (or state 20*d*), such that between the two products 20 the first and second seals are created on the film 21, respectively.

As described in more detail further below, evacuation of packages is achieved by compression of portion 68 between portion 66 of head 60*a* and support 60*b*. By means of the compression, the internal volume of chamber 60*c* is reduced, resulting in a corresponding increase in pressure within chamber 60*c*. Due to the fact, that the package within chamber 60*c* is a semi-sealed package 23 having an open end extending out from chamber 60*c*, the increased pressure facilitates expulsion of air from inside the package and through the open end thereof. One key factor in the evacuation, as described in detail with respect to FIGS. 3A to 3C below, is that portion 68 contacts support 60*b* sufficiently tight enough as to prevent loss of pressure along a perimeter of portion 68. Further, portion 68 must contact material at the open end of a semi-sealed package 23 sufficiently tight enough to also prevent loss of pressure in this region of the perimeter, while still allowing the expulsion of air through the open end. In other words, the contact pressure and/or shape and/or compliance within the region of portion 68 in contact with the semi-sealed package needs to be selected in order to both prevent loss of pressure within chamber 60*c* and achieve expulsion of air/gas from inside the semi-sealed package 23. The contact pressure must neither be too high (e.g. resulting in blocking of the flow through the open end of semi-sealed package 23) nor too low (e.g. resulting in insufficient pressure within chamber 60*c*).

As soon as the air inside a semi-sealed package 22 has been expelled, sealing and cutting members 31 and 32 create the second seal at the open end of semi-sealed package 22, thereby creating sealed package 23 containing product 20. Sealing and cutting members 31 and 32 may, during the same operation, create the first sealed end for the packaging of the subsequent product 20, which is in state 20*a*, situated inside tubular film 21, upstream of now sealed package 23, thereby creating a semi-sealed package 22 for the subsequent product 20.

Means for moving 30 may comprise one or more conveyor belts 30. The one or more conveyor belts are configured to transport the products 20 in states 20*a*, 20*b*, and 20*c*, for example as packages 22 and 23, along a pre-defined path through the packaging apparatus 1. For example, the packaging apparatus may comprise at least two conveyor belts 30 as shown in FIG. 1. A first conveyor belt 30 is configured to transport the product 20 and/or film 21 upstream of the sealing and cutting members 31 and 32. A second conveyor belt 30 is configured to transport the product 20 and/or packages 22 and/or 23 downstream of sealing and cutting members 31 and 32. Sealing and cutting members 31 and 32 may further be configured to separate the semi-sealed packages 22 from the sealed packages 23 when forming the first and second seals. As shown, sealing station 3 includes sealing and cutting members 31 and 32 and a separation of packages 22 and/or 23 may be effected substantially at the same time when sealing the packages 22 and/or 23.

Figure 2:
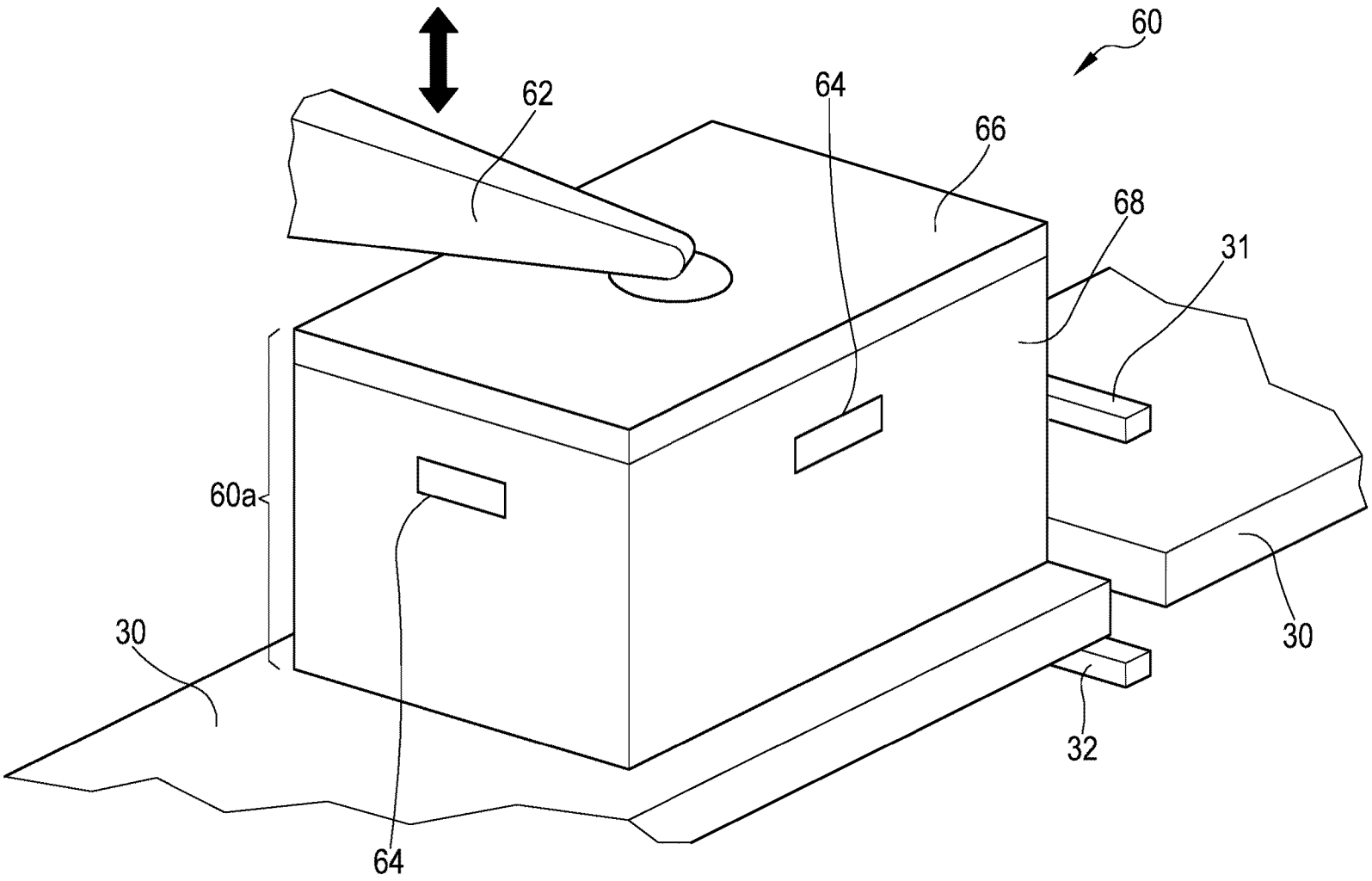
FIG. 2 schematically shows an isometric view of an evacuation assembly in accordance with the first embodiment of the present invention.

FIG. 2 schematically shows an isometric view of an evacuation assembly 60 in accordance with the first embodiment of the present invention. In FIG. 2, head 60*a* of evacuation assembly 60 is shown in a configuration in which chamber 60*c* is closed due to portion 68 being in contact with support 60*b* (not shown; support 60*b* is covered by head 60*a*). Portion 68 may comprise one or more flow regulators 64 configured for controlled release of air/gas from inside chamber 60*c*. A flow regulator 64 may be present in the form of one or more openings in apron 68 having a size selected to achieve a desired air/gas flow from and out of chamber 60*c* upon an increase in pressure within chamber 60*c*. Flow regulator 64 may have other forms as known in the art, for example, a valve, a filter, a membrane, a flap, or other. Evacuation assembly 60 may have a generally box-shaped form as shown in FIG. 2. Alternatively, evacuation assembly 60 may have another form, for example generally cylindrical or that of a hemisphere.

Figure 3:
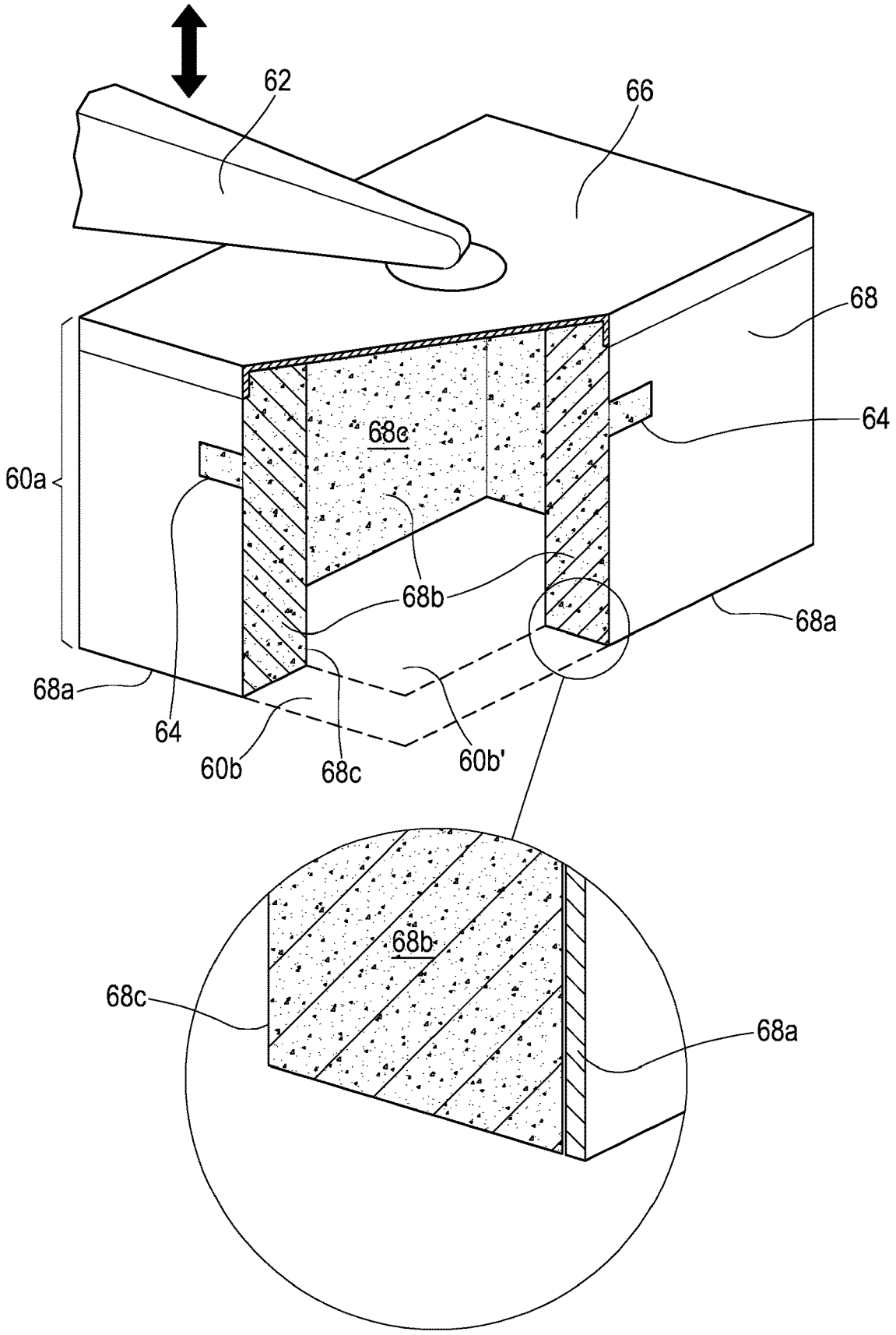
FIG. 3 schematically shows an isometric view and a magnified detail of the evacuation assembly in accordance with the first embodiment of the present invention and as shown in FIGS. 1 and 2, in which a section of the holder and apron is removed to illustrate the (inner) structure of the evacuation assembly 60.

FIG. 3 schematically shows an isometric view and a magnified detail of the evacuation assembly 60 in accordance with the first embodiment of the present invention and as shown in FIGS. 1 and 2, in which a section of holder 66 and apron 68 is removed to illustrate the (inner) structure of the evacuation assembly 60. Chamber 60*c* is circumferentially delimited by the inner wall 68*c* of inner layer 68*b* of apron 68. Further, chamber 60*c* is delimited at one end by holder 66 while a second end, opposite the first end, is left open in order to potentially be closed by a corresponding working surface (e.g. support 60*b*; see FIG. 1). The magnified detail illustrates an exemplary structure of apron 68, where the wall delimiting chamber 60*c* is composed of multiple layers of material. Inner layer 68*b* may comprise a suitable compliant material that is at least partly permeable to air/gas and that is compressible at least in a direction parallel to the inner wall 68*c*, extending from holder 66 towards the second end of apron 68. An example material for inner layer 68*b* is foam material, for example plastic foam or rubber foam. Outer layer 68*a* may comprise a suitable compliant material that is substantially impermeable to air/gas and that can accommodate a deformation of inner layer 68*b* (e.g. due to compression) without delamination between both layers 68*a* and 68*b*. An example material for outer layer 68*a* is plastic film, comprising one or more layers.

FIG. 3 further illustrates two flow regulators 64 arranged in the side wall defined by apron 68. Flow regulators 64 are arranged as openings provided in outer layer 68*a* and are shapes and sizes such that upon compression of apron 68 due to a relative movement between holder 66 and support 60*b* an increasing pressure within chamber 60*c* can be maintained and/or released in a controlled manner. For example, flow regulators 64 are shaped and sized such that the inner pressure within chamber 60*c* increases, during compression of apron 68, up to a positive pressure of 101 kPa to 150 kPa, preferably from 105 kPa to 120 kPa, more preferably from 110 kPa to 115 kPa (all values indicating absolute pressure). A corresponding (maximum) pressure differential between the inner pressure within chamber 60*c* and ambient pressure (e.g. 100 kPa) outside chamber 60*c* would, thus, range from 1 kPa to 50 kPa, preferably from 5 kPa to 20 kPa, more preferably from 10 kPa to 15 kPa. It is noted that a desired pressure profile during contact between head 60*a* and support 60*b*, compression of apron 68, decompression, and separation of head 60*a* and support 60*b* can be modified by several parameters, including, but not limited to: a ratio between size of chamber 60*c* before and during compression, a permeability of material of inner layer 68*b* of apron 68 to air/gas, a shape and/or size and/or number of flow regulators 64 present in outer layer 68*a*, a speed of compression of apron 68.

Figure 3A:
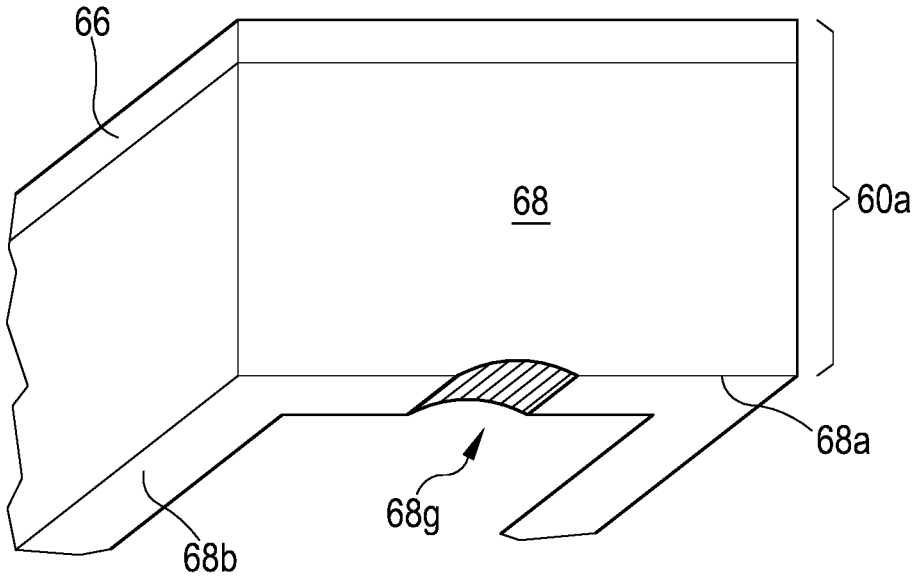
FIG. 3A shows an isometric view of an upstream end of the evacuation assembly in accordance with a first variant of the first embodiment of the present invention.

FIG. 3A shows an isometric view of an upstream end of the evacuation assembly in accordance with a first variant of the first embodiment of the present invention. In some embodiments, including any one of the first, second, third, and fourth embodiments, an upstream end of head 60*a* comprises one or more channels 68*g*. Generally, the terms "upstream" and "downstream" pertain to a movement direction 30' (see, e.g., FIGS. 1, 4A-4D, 7A-7D) of products 20 through packaging apparatus 1. Thus, in the embodiment shown in FIG. 1, the upstream end of head 60*a* is located proximal to sealing station 3, while the downstream end of head 60*a* is located distal thereto (i.e. proximal to shrink tunnel 33).

FIG. 3A shows portion 68 of head 60*a* having a single channel 68*g*. It is noted that portion 68 can have any number of channels 68*g* as desired with respect to the individual packaging application. For example, for evacuation of wider packages, channel 68 may have a wider configuration (e.g. extend along substantially 30% of the width of head 60*a*, preferably 60%, more preferably 80%). Alternatively, a plurality of channels 68*g* can be provided extending parallel to a longitudinal direction of head 60*a* (i.e. in upstream-downstream direction, or parallel to motion direction 30') and parallel to one another along the width of head 60*a* (this example is not shown in FIG. 3A), thus resulting in a similar open cross section being provided (as the sum of the cross sections of the plurality of channels) as with a corresponding single channel.

The one or more channels 68*g* are configured to prevent excess pressure upon support 60*b* and/or part of tubular film 21, which in use is resting against the second member 60*b*, such that upon compression of portion 68 air and/or gas can flow through the part of tubular film resting against the support 60*b*. The one or more channels 68*g* are configured to allow fluid communication between the inside of a semi-sealed package 23 and an ambient atmosphere through the open end of the semi-sealed package 23 (for clarity, the semi-sealed package 23 is not shown in FIGS. 3A to 3C).

Figure 3B:
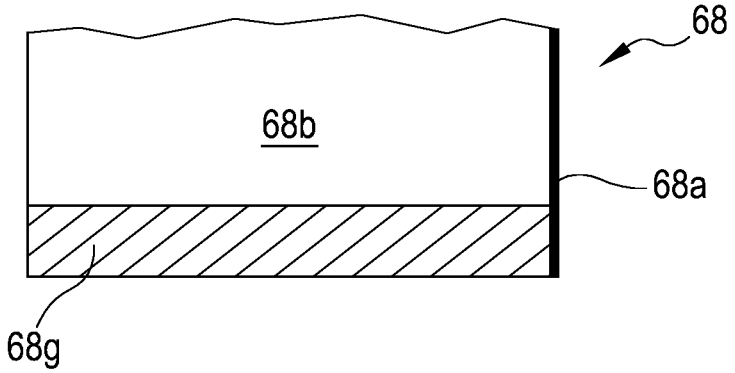
FIG. 3B shows a longitudinal cross section view of the upstream end of the evacuation assembly shown in FIG. 3A.

FIG. 3B shows a longitudinal cross section view of the upstream end of the evacuation assembly shown in FIG. 3A. As shown, the one or more channels 68*g* can be provided in both layers 68*a* and 68*b*, such that the one or more channels 68*g* provide for an expansion region for at least part of the tubular film 21 resting against support 60*b*.

Figure 3C:
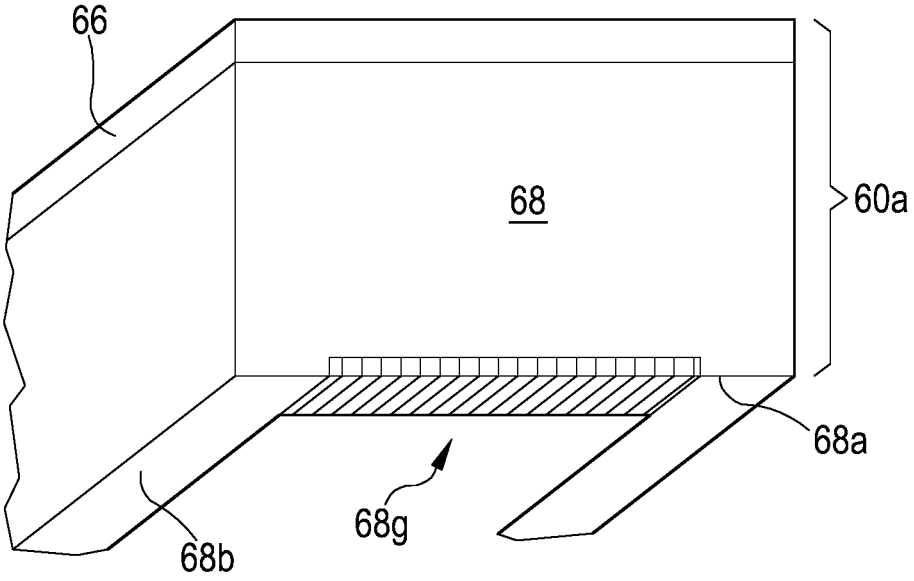
FIG. 3C shows an isometric view of an upstream end of the evacuation assembly in accordance with a second variant of the first embodiment of the present invention.

FIG. 3C shows an isometric view of an upstream end of the evacuation assembly in accordance with a second variant of the first embodiment of the present invention. In some embodiments, including any one of the first, second, third, and fourth embodiments, the one or more channels 68*g* in accordance with the second variant are provided in portion 68 in form of a region having a compliance different from that of the remainder of portion 68 in correspondence of the upstream end of head 60*a*. In general, the one or more channels 68*g* comprise a more compliant material configured to reduce a compression force applied to support 60*b* and/or tubular film 21 resting against support 60*b*, upon compression of portion 68 against support 60*b*. The one or more channels 68*g* in accordance with the second variant can have any shape, size, thickness, configuration, distribution, or composition that allows the aforementioned reduction of pressure.

As shown, one or more channels 68*g* in accordance with the second variant can be provided as a continuous layer of compliant material (e.g. material more compliant than a material of portion 68; e.g. soft plastic foam material) arranged along a region of contact between portion 68 and support 60*b* and/or tubular film 21 resting against support 60*b*, thereby reducing a contact force exerted by portion 68 in this region of contact. In this example, the one or more channels 68*g* can be provided as a separate layer placed upon inner layer 68*b* (the latter being provided with a corresponding recess receiving the one or more channels 68*g*). An outer layer 68*a* can extend over the one or more channels 68*g* or being provided with a corresponding recess. It is noted that the outer layer 68*a*—if present—typically does not exert a substantial pressure upon support 60*b* and/or tubular film 21 resting against support 60*b*. It is further noted that the first and second variants are specifically disclosed also with respect to embodiments of head 60*a* having a portion 68 comprising a bellows structure 65 (see further below; e.g. FIG. 6A, 6B). The one or more channels 68*g* can be provided in substantially the same manner as described above (e.g. as one or more open channels and/or as one or more channels comprising a more compliant material reducing the pressure exerted by portion 68.

In some embodiments, including any one of the first, second, third, and fourth embodiments, the one or more channels 68*g* can be configured to perform a function corresponding to that of the flow regulators 64 and/or 64' (see above). To this aim, the configuration (e.g. size, shape, number, etc.) and/or the material (e.g. more or less permeable plastic foam) of the one or more channels 68*g* can be selected in line with the desired air/gas flow between the inside and the outside of chamber 60*c*.

FIGS. 4A to 4D show different operational states of packaging apparatus 1 shown in FIG. 1, illustrating corresponding packaging process steps in accordance with all embodiments of the present invention. It is noted that the second, third, and fourth embodiments of the present invention, as shown, for example in FIGS. 5, 6A, 6B, 8A and 8B substantially employ the same packaging process steps and merely exhibit some structural differences pertaining to head 60*a*, in particular, apron 68. Therefore, the process steps described in the following are applicable to all embodiments, unless a particular embodiment is explicitly referred to.

Figure 4A:
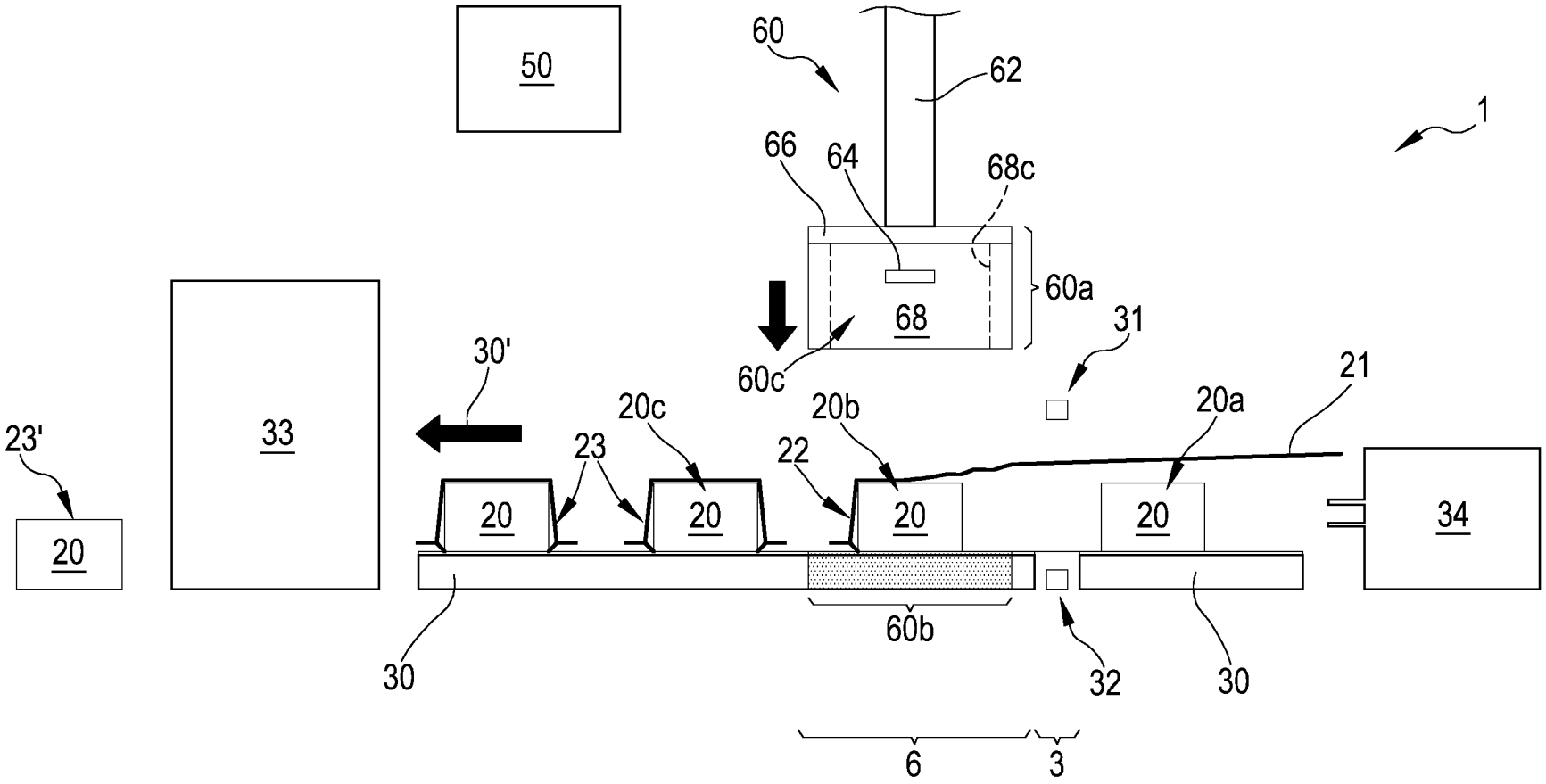
FIGS. 4A to 4D show different operational states of the packaging apparatus shown in FIG. 1, illustrating corresponding packaging process steps in accordance with all embodiments of the present invention.

FIG. 4A shows a first operational state of packaging apparatus 1. A product 20 is placed within a working portion 60*b*' of support 60*b* such that the semi-sealed package 22 as well as product 20 arranged within semi-sealed package 22 are placed within working portion 60*b*' of support 60*b* and that the open end of package 22 extends beyond working portion 60*b*' and support 60*b*. Working portion 60*b*' is defined as the portion of support 60*b* that is comprised within chamber 60*c* upon contact of apron 68 with support 60*b*. Head 60*a* and support 60*b* are in a spaced-apart configuration in order to facilitate placement of product 20 within working portion 60*b*' of support 60*b* as described above. The distance between head 60*a* and support 60*b* can be configured as desired and/or depending upon the size of products to be packaged. In the embodiment shown, control unit 50 is configured to control conveyor belt 30 such that product 20 in semi-sealed package 22 is placed as described.

Figure 4B:
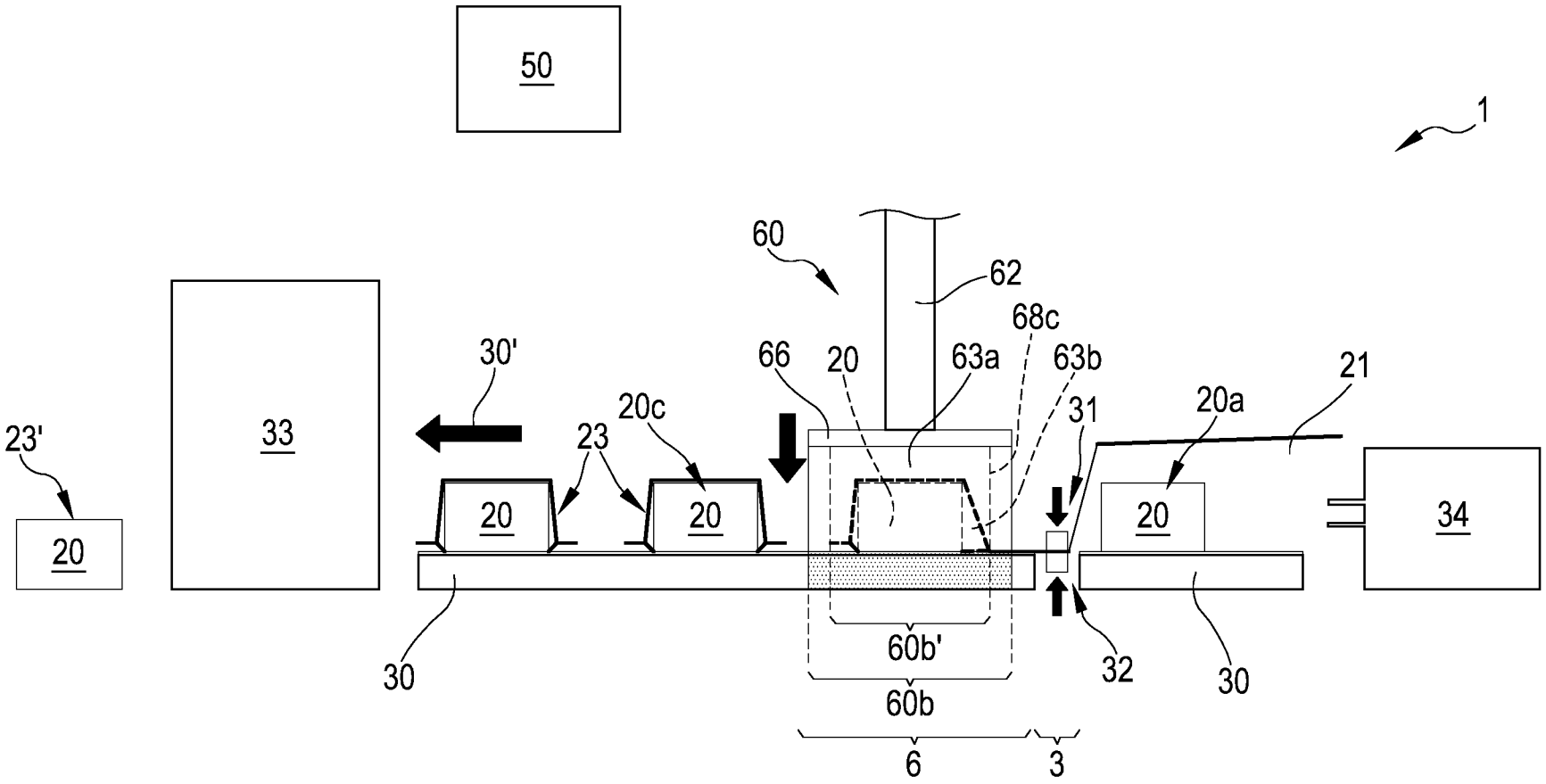

In a first step, as shown in the transition between FIGS. 4A and 4B, control unit 50 is configured to control a spacing between head 60*a* and support 60*b* such that both are brought into contact with one another, thereby closing chamber 60*c* around product 20 and holding the open end of semi-sealed package 22 between head 60*a* and support 60*b*, extending outwards from chamber 60*c* and into a working area of sealing station 3 (e.g. between sealing and cutting bars 31 and 32). In the embodiment shown, actuator 62 is controlled to effect a movement of head 60*a* towards (and away from) support 60*b*. However, it is noted that the relative movement can be achieved in other ways known to a person skilled in the art, for example by moving both head 60*a* and support 60*b*, or by moving only support 60*b*. In some embodiments, the distance D1 between holder 66 and support 60*b*, when apron 68 is in contact with support 60*b*, ranges from 100 mm to 500 mm and defines an internal volume V1 of chamber 60*c* (the internal volume V1 may for instance be between 8 liters and 40 liters).

As the second open end of package 22 is held between head 60*a* and support 60*b* as well as between sealing and cutting bars 31 and 32 of sealing station 3, an inner volume 63*b* contained within semi-sealed package 22 is still in fluid communication with the ambient atmosphere by means of a channel defined between opposing layers of film along the second open end of package 22. An outer volume 63*a*, outside of semi-sealed package 22 and inside chamber 60*c*, is substantially sealed from the ambient atmosphere by head 60*a* substantially sealingly contacting support 60*b* as well as semi-sealed package 22. FIG. 4B illustrates chamber 60*c* having a certain volume 63*a*.

Figure 4C:
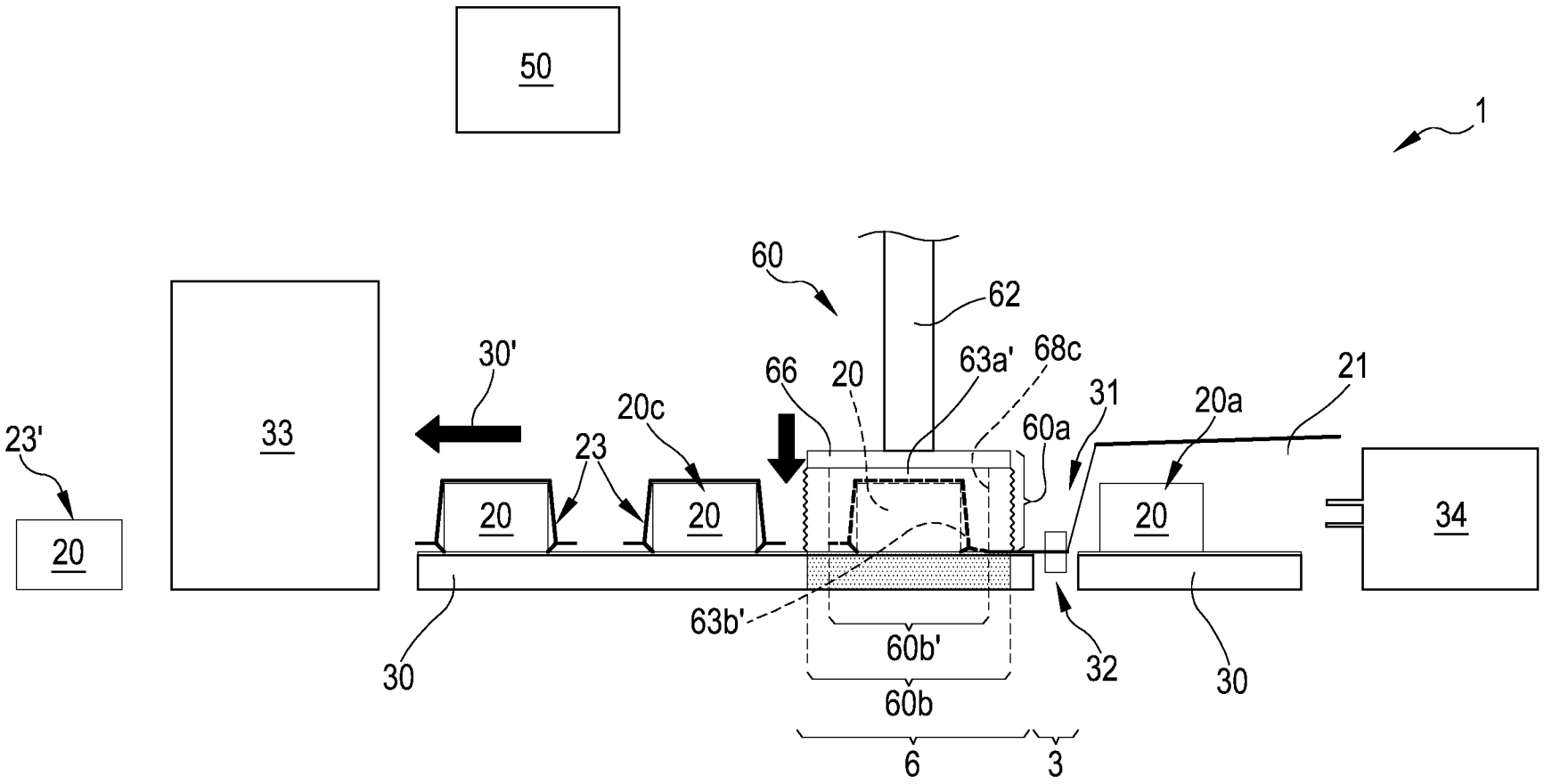

In a second step, as shown in FIG. 4C, holder 66 is further moved towards support 60*b*, thereby compressing apron 68 against support 60*b*. The deformation of apron 68 thus achieved results in chamber 60*c* decreasing in volume from volume 63*a* (see FIG. 4B) to volume 63*a*' (see FIG. 4C), which is smaller than volume 63*a*. This entails a corresponding increase in pressure within chamber 60*c*. Thus, the increase of pressure within chamber 60*c* acts upon the outer surface of semi-sealed package 22 and thereby decrease its internal volume 63*b* (see FIG. 4B), expelling air/gas from inside semi-sealed package 22 through the second open end of package 22, thereby reducing the inner volume 63*b* to inner volume 63*b*', smaller than inner volume 63*b*. As illustrated in FIG. 4C, the inner volume 63*b*' of semi-sealed package 22 decreases as air/gas is expelled and, thus, film 21 conforms more closely to the shape of product 20. In some embodiments, the distance D2 between holder 66 and support 60*b*, when apron 68 is compressed against support 60*b*, ranges from 50 mm to 250 mm, preferably 80 mm to 150 mm and the internal volume V2 of chamber 60*c* ranges from 6 liters to 30 liters, preferably 9.6 liters to 18 liters. In other words the change in volume determined by the second step brings a reduction of the internal volume of the chamber 60*c* of at least 20%, optionally at least 25% compared to the initial internal volume V1 after the first step and before the second step. Analogously the distance D2 is smaller by at least 20%, optionally by at least 25%, compared to distance D1.

Figure 4D:
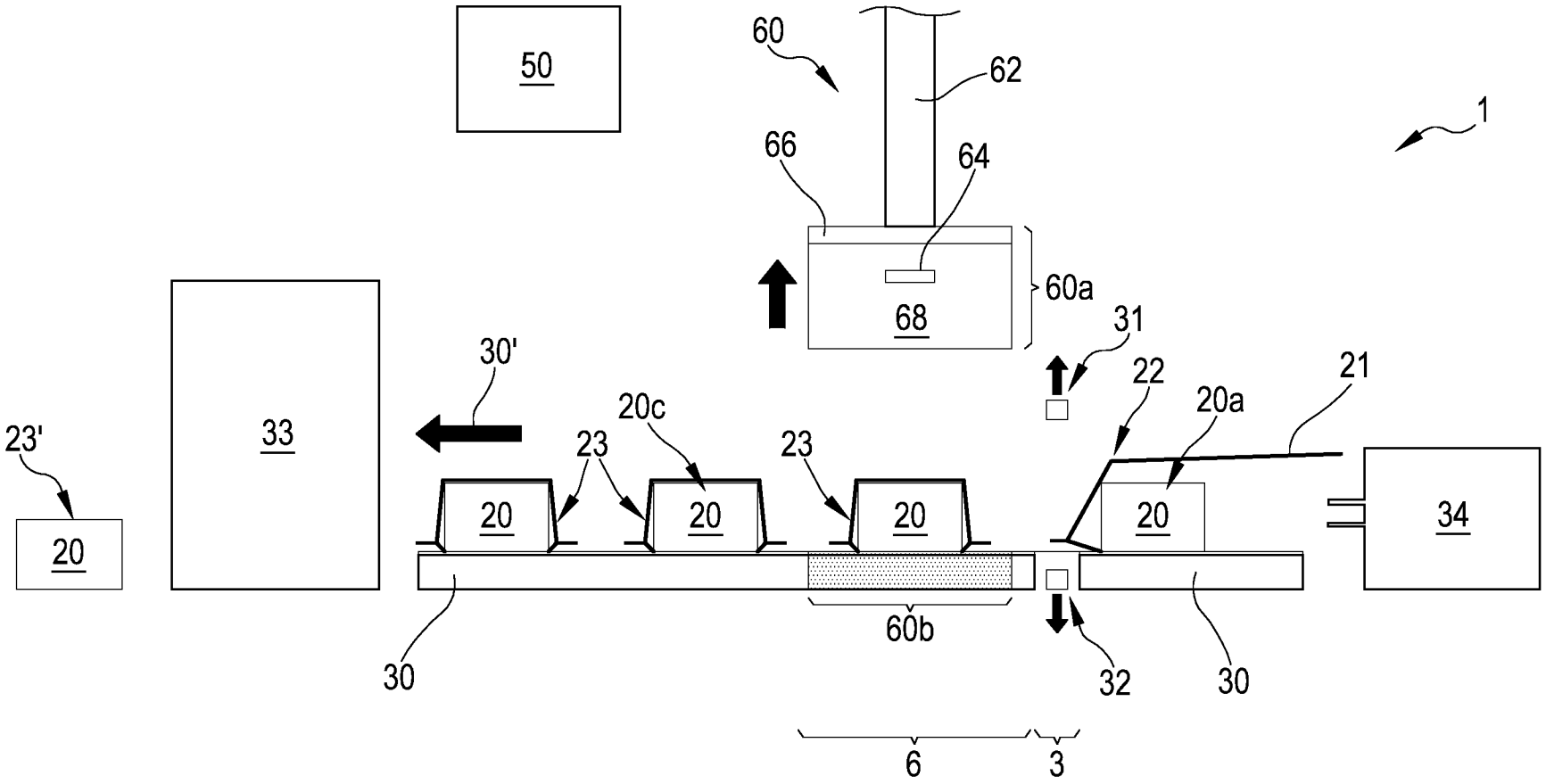

Upon completion of air/gas expulsion, as shown in FIG. 4D, control unit 50 is configured to control sealing and cutting members 31 and 32 so as to provide film 21 with corresponding seals and to cut package 23, which is now sealed at both ends, from tubular film 21, which has been once again formed into a semi-sealed package. Control unit 50 is further configured to control actuator 62 to move into a spaced-apart configuration, thereby facilitating removal (e.g. further transportation by means for moving 30) of package 23 from below head 60*a* and arrangement of a subsequent semi-sealed package 22 in correspondence of the working portion 60*b*' of support 60*b*. Substantially at the same time, sealing and cutting members 31 and 32 are controlled to release film 21 in order to allow for transportation of packages 23 and 22. After a subsequent semi-sealed package 22 has been arranged in correspondence of the working portion 60*b*' of support 60*b*, the process starts again as described above with respect to FIG. 4A and following.

With respect to the process steps described above, it is noted that the movements of head 60*a* and/or support 60*b* may be performed in accordance with a pre-determined respective profile defining one or more of the following parameters. The rate of relative movement over time can range from 0.5 m/s to 2.0 m/s. In some embodiments the rate of movement preferably ranges from 0.7 m/s to 1.5 m/s and more preferably from 1.0 m/s to 1.2 m/s. The retention time, which denotes head 60*a* and/or support 60*b* being held in a fixed configuration with respect to one another, may range from 0.05 s to 1.0 s, minimum and maximum retention time, respectively. In some embodiments the retention time preferably ranges from 0.1 s to 0.7 s, and more preferably from 0.1 s to 0.3 s. These minimum and maximum retention times are applicable to one or more of the spaced apart configuration (see FIG. 4A), the configuration in which head 60*a* and support 60*b* are in contact with one another (see FIG. 4B), and the configuration in which head 60*a* and support 60*b* are in the compressed configuration (i.e. where apron 68 is compressed against support 60*b*; see FIG. 4C). An actuation force applied to head 60*a* and/or support 60*b*, when relatively moving head 60*a* and/or support 60*b* into one of the spatial configurations, ranges from 5 N to 400 N, preferably from 20 N to 200 N.

Figure 5:
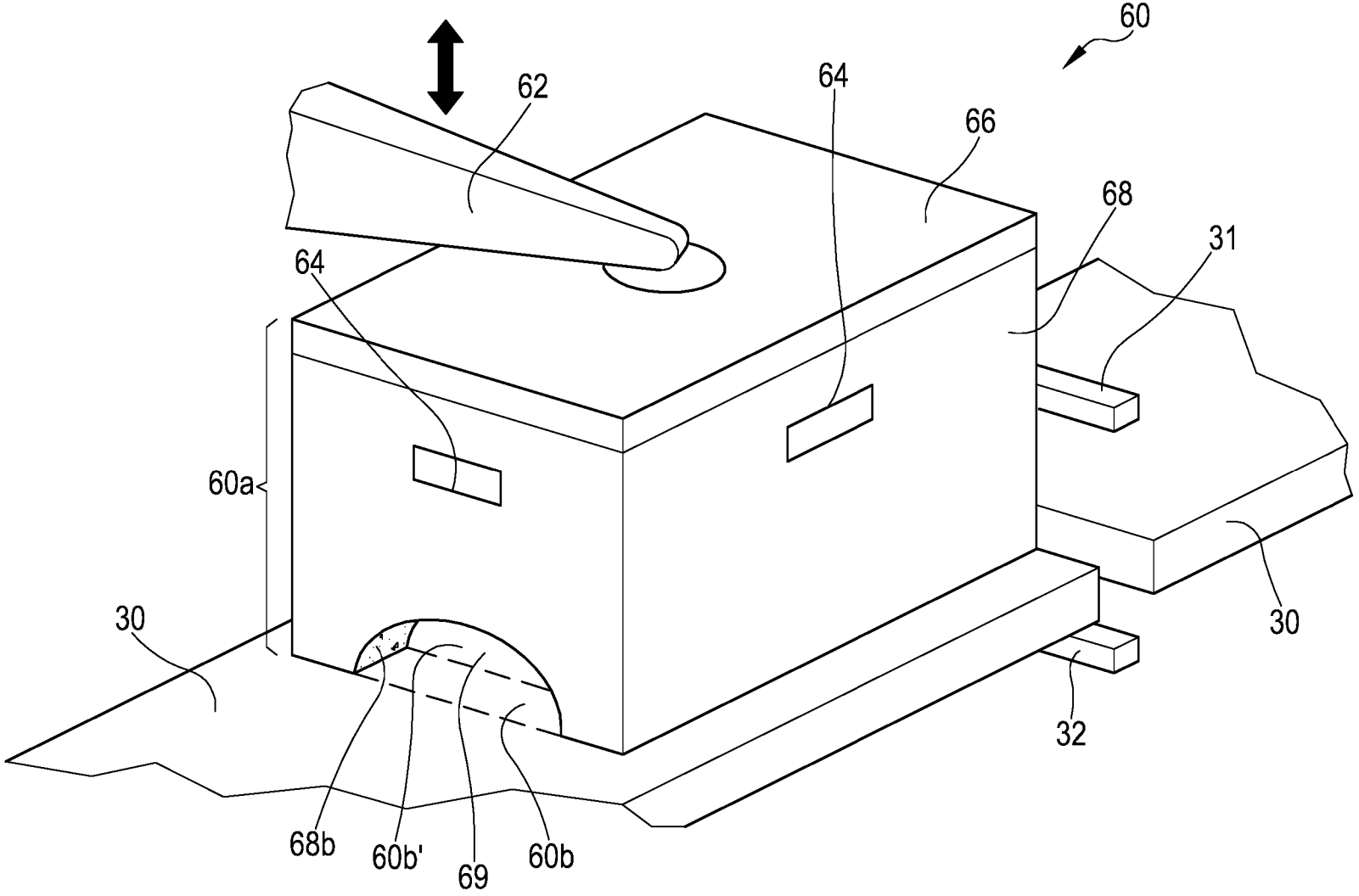
FIG. 5 schematically shows an isometric view of an evacuation assembly in accordance with a second embodiment of the present invention.

FIG. 5 schematically shows an isometric view of an evacuation assembly 60 in accordance with a second embodiment of the present invention. Head 60*a* in accordance with the second embodiment of the invention substantially corresponds to head 60*a* in accordance with the first embodiment, except for a recess 69 present in apron 68. One purpose of recess 69 is to allow for a closer placement of products within tubular film 21 so that head 60*a* can be brought into contact with support 60*b* even though a previously evacuated and sealed package 23 is still arranged partly within working portion 60*b*' of support 60*b*. Package 23 (not shown in FIG. 5) may then allow for a substantially sealed contact between apron 68 and support 60*b* by substantially filling recess 69. Due to the compliance of apron 68, recess 69 does not have to correspond exactly to the shape and/or size of package 23. However, due to the material removed from apron 68 in correspondence of recess 69, the deformation of apron 68 does not have to progress beyond the material's abilities to conform to package 23 and still ensure sufficiently close contact between apron 68 and support 60*b*.

In other embodiments, the material of the downstream wall of apron 68 can be made from a more compliant material. This variant allows the downstream wall to accommodate a preceding packaged product without necessitating a recess 69. In such embodiments, the downstream wall of apron 68 can be made from an inner layer comprising a more compliant (e.g. softer, more flexible) material or it can comprise an inner layer 68*b* having a smaller thickness. It is noted that the variant also applies to the other embodiments shown, in particular to embodiments in which apron 68 has a bellows type structure. Also in these embodiments, the downstream wall can be modified with respect to the remaining walls of apron 68 in the same manner as described above.

Figure 6A:
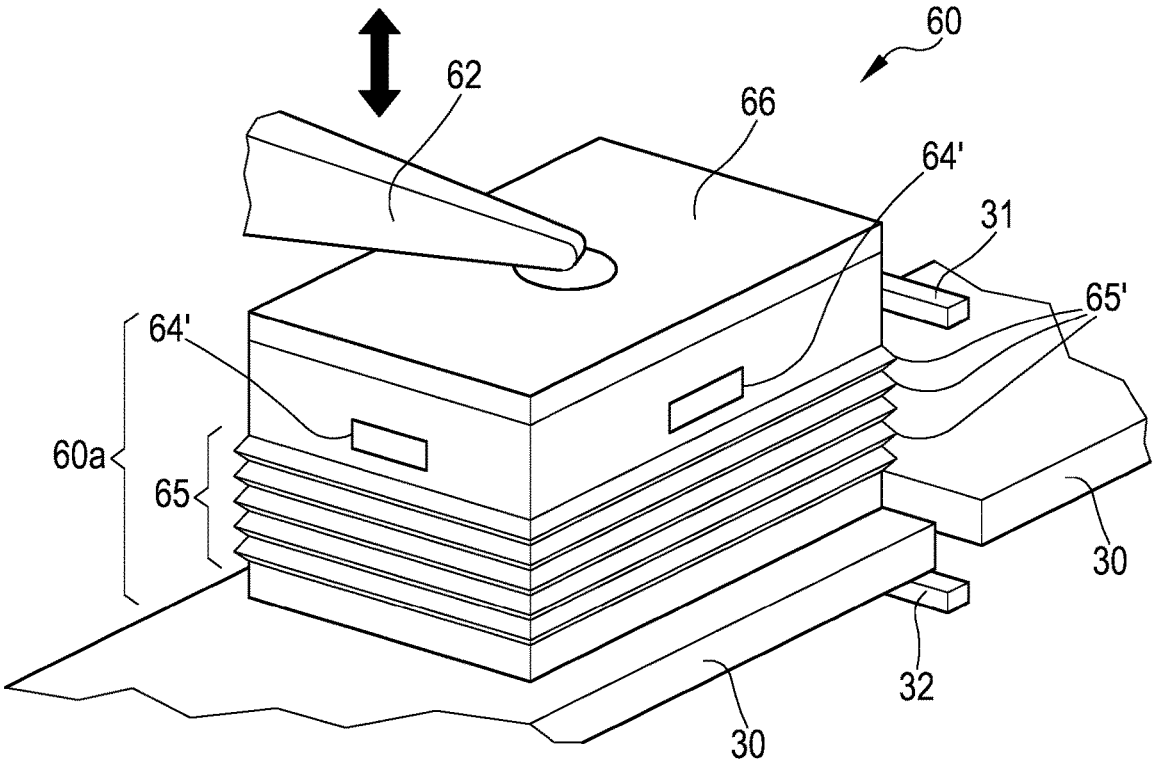
FIG. 6A schematically shows an isometric view of an evacuation assembly in accordance with a third embodiment of the present invention.

FIG. 6A schematically shows an isometric view of an evacuation assembly 60 in accordance with a third embodiment of the present invention. Elements corresponding to the same or similar elements in the first and second embodiments are referred to by the same reference numerals. As can be seen from FIG. 6A, a main difference in the third embodiment pertains to the structure of apron 68, which (also) comprises a compliant material but further exhibits structural features having an impact on the compliance of apron 68. Apron 68 has folds 65' that provide apron 68 with a bellows structure 65. The size, number, and/or arrangement of folds 65' in bellows 65 provide apron 68 with the ability to accommodate different spatial extensions depending upon a spacing between holder 66 and support 60*b* (not shown in FIG. 6A for clarity; as shown in the cross-section view of FIGS. 1 and 4A-4D, means for moving 30 provide support 60*b*). Fold 65' may have a size and shape suitable for providing apron 68 with a compliant structure. The number of fold 65' may be varied according to a desired compliance. In one example, apron 68 has five folds 65'. However, depending upon the individual application, size and shape of apron 68, and/or the material of apron 68, the number of folds 65' comprised in bellows 65 can be higher or lower and range from, for example, 1 to 20, preferably from 3 to 15, more preferably from 5 to 10. The extension of bellows 65 with respect to apron 68 may be chosen as desired. For example, bellows 65 can extend substantially over 50% of apron 68. In some examples, bellows 65 extends over 20% to 80% of apron 68. In other examples, bellows 65 can extend substantially over the entire apron 68.

Figure 6B:
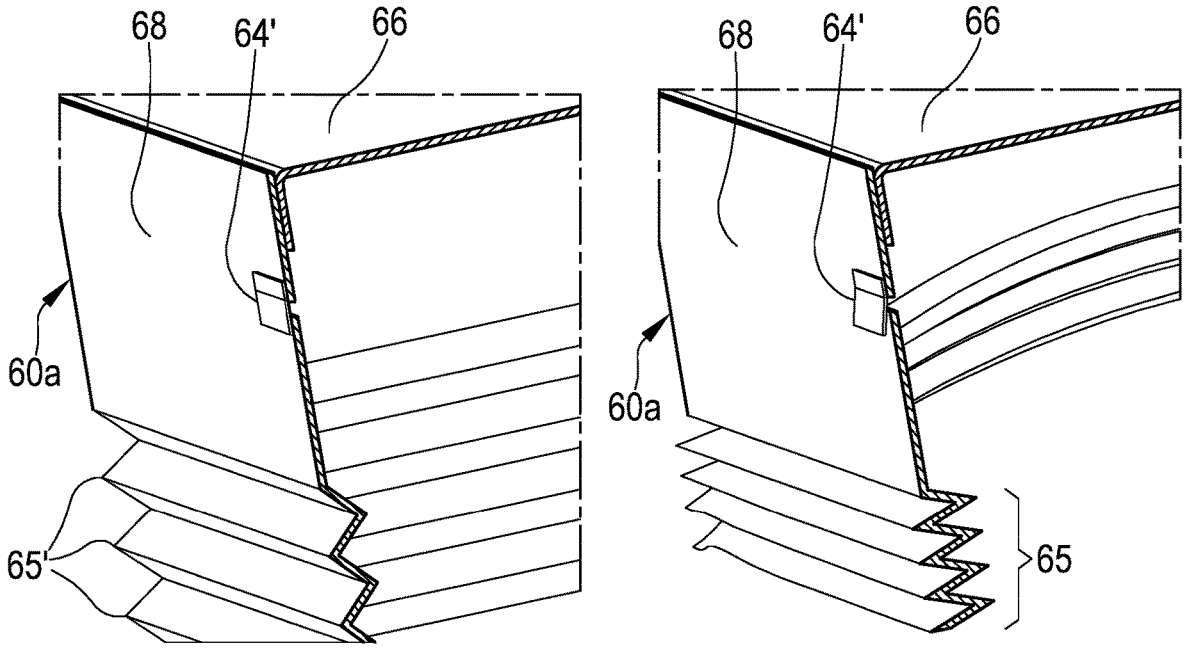
FIG. 6B schematically shows magnified details an evacuation assembly in accordance with the third embodiment of the present invention, illustrating two different operational states of the evacuation assembly.

FIG. 6B schematically shows magnified details an evacuation assembly 60 in accordance with the third embodiment of the present invention, illustrating two different operational states of the evacuation assembly. On the left, bellows 65 of head 60*a* is shown in an expanded state, which may be present when head 60*a* is not in contact with support 60*b* or upon initial contact between head 60*a* and support 60*b*, before compression of apron 68. In the expanded state, chamber 60*c* is either open or closed against support 60*b*. If chamber 60*c* is closed against support 60*b*, it delimits a volume within chamber 60*c* (e.g. volume 63*a* as shown in FIG. 4B).

On the right of FIG. 6B, bellows 65 of head 60*a* is shown in an compressed state, which may be present when head 60*a* is in contact with support 60*b*, after compression of apron 68. In the compressed state, chamber 60*c* is closed against support 60*b* and delimits a volume within chamber 60*c* (e.g. volume 63*a*' as shown in FIG. 4C) smaller than volume 63*a* when apron 68 is not in the compressed state. It can be seen from the spacing between folds 65' as shown on the left and on the right of FIG. 6B that individual folds 65' are less closely spaced on the left, before compression, and more closely spaces on the right, after compression. In this manner, the decrease in volume—as well as the desired increase in pressure—within chamber 60*c* can be achieved.

FIG. 6B also shows an exemplary flow regulator 64'. Flow regulator 64' comprises a flap or cover and an opening within the sidewall of apron 68. On the left of FIG. 6B, flow regulator 64' is shown in a closed state. When chamber 60*c* is open, or when chamber 60*c* is closed before compression of apron 68, flow regulator 64' is closed and prevents air/gas flow between the outside atmosphere and the inner volume of chamber 60*c*. Upon compression or apron 68 and the resulting increase in pressure within chamber 60*c*, air/gas from inside chamber 60*c* is forced through the opening of flow regulator 64' and through its flap or cover, thereby preventing an increase in pressure within chamber 60*c* beyond a desired value. The size and shape of the opening of flow regulator 64' as well as the configuration (e.g. size, shape, resistance, material, bias, etc.) of the flap or cover may be modified as desired in order to achieve the intended maximum pressure upon compression of apron 68. It is noted that many other forms of flow regulators can be employed here, for example, a number of active of passive valves, permeable membranes having different density, or perforated regions within the sidewall of apron 68.

Figure 7A:
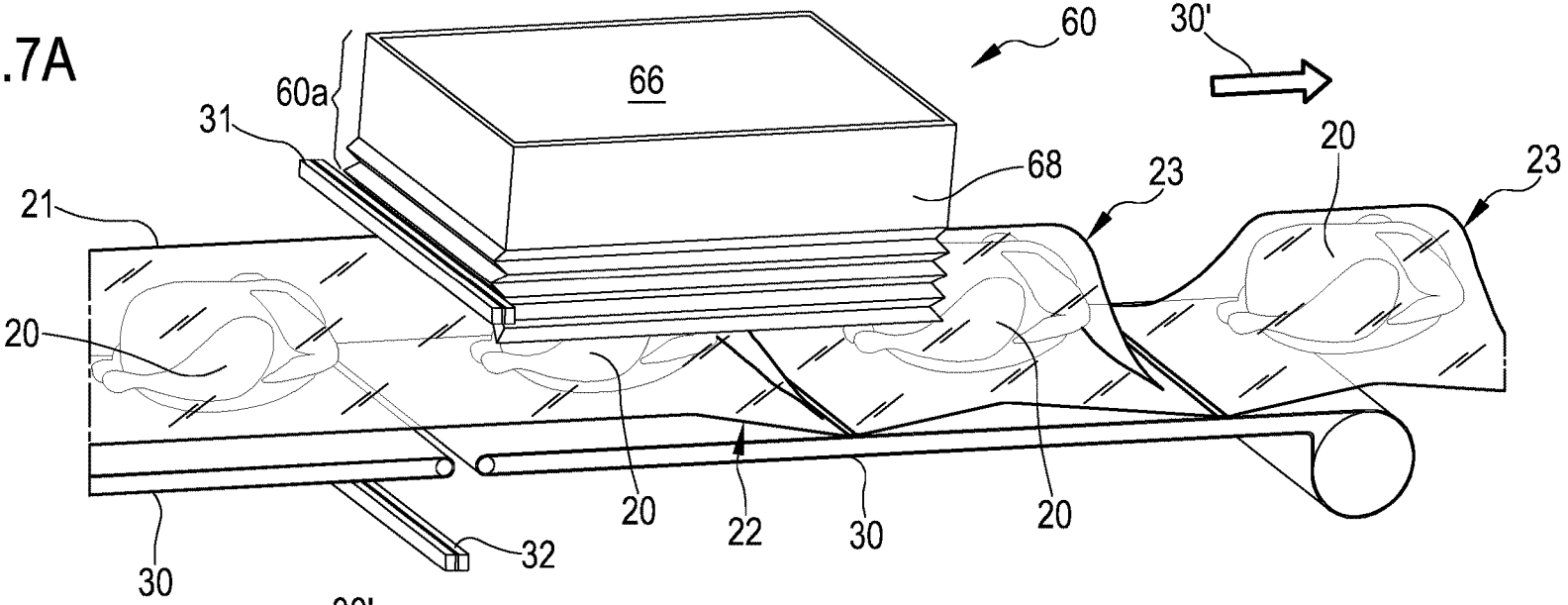
FIGS. 7A to 7D show different operational states of a packaging apparatus similar to the packaging apparatus as shown in FIG. 1, illustrating corresponding packaging process steps in accordance with the third embodiment of the present invention.
Figure 7B:
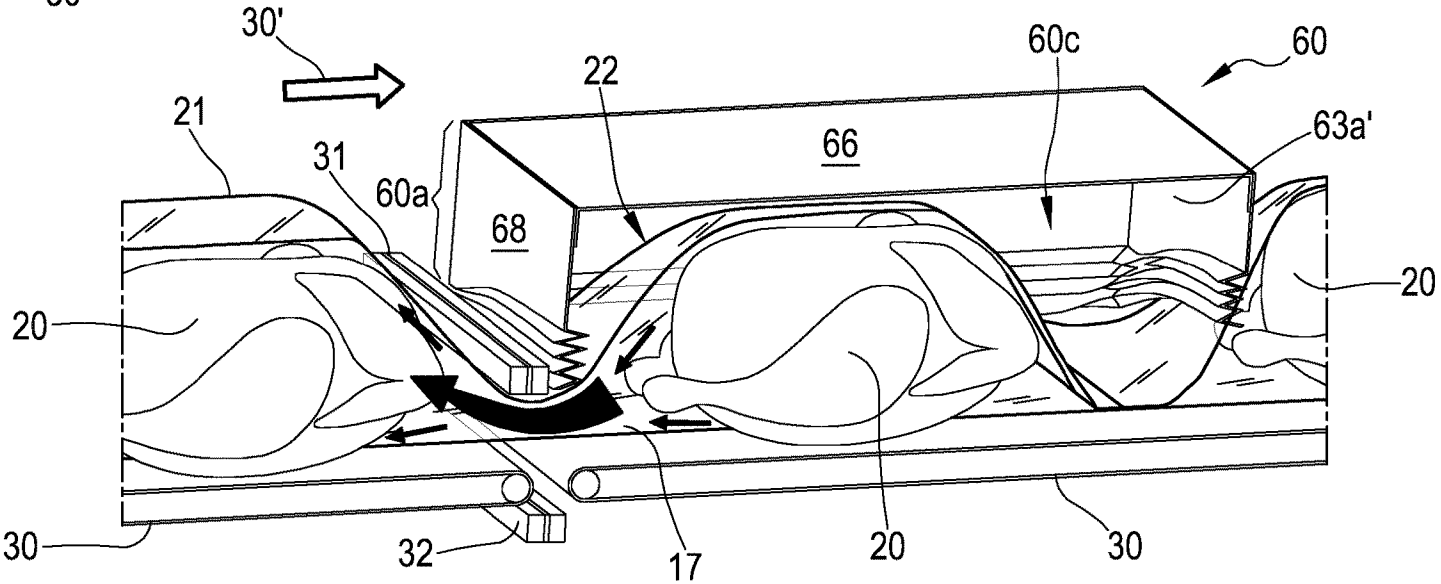

FIGS. 7A to 7D show different operational states of a packaging apparatus similar to the packaging apparatus 1 as shown in FIG. 1, illustrating corresponding packaging process steps in accordance with the third embodiment of the present invention. It is noted that the first and second embodiments of the present invention, as shown, for example in FIGS. 1 to 5, substantially employ the same packaging process steps and merely exhibit some structural differences pertaining to head 60*a*, in particular, apron 68. Therefore, the process steps described in the following are applicable to all embodiments, unless a particular embodiment is explicitly referred to. In FIGS. 7A to 7D, the movement direction of packages 22, 23 through the packaging apparatus is from left to right, and FIG. 7B shows a cross-section view of evacuation assembly 60, in order to show more clearly the different packaging and evacuation steps.

FIG. 7A shows a first operational state of packaging apparatus 1. A product 20 (here poultry) is placed within a working portion 60*b*' of support 60*b* (both not shown for clarity, cf. FIGS. 4A to 4D) such that the semi-sealed package 22 as well as product 20 arranged within semi-sealed package 22 are placed within working portion 60*b*' of support 60*b* and that the open end of package 22 extends beyond working portion 60*b*' and support 60*b*. Working portion 60*b*' is defined as the portion of support 60*b* that is comprised within chamber 60*c* upon contact of apron 68 with support 60*b*. Head 60*a* and support 60*b* are in a spaced-apart configuration in order to facilitate placement of product 20 within working portion 60*b*' of support 60*b* as described above. In the embodiment shown, control unit 50 is configured to control conveyor belt 30 such that product 20 in semi-sealed package 22 is placed as described.

In a first step, as shown in the transition between FIGS. 7A and 7B, control unit 50 is configured to control a spacing between head 60*a* and support 60*b* such that both are brought into contact with one another, thereby closing chamber 60*c* around product 20 and holding the open end of semi-sealed package 22 between head 60*a* and support 60*b*, extending outwards from chamber 60*c* and into a working area of sealing station 3 (e.g. between sealing and cutting bars 31 and 32). Holder 66 is then further moved towards support 60*b*, thereby compressing apron 68 against support 60*b* such that the bellows 65 is compressed (e.g. folds 65' are folded towards one another). The deformation of apron 68 thus achieved results in chamber 60*c* decreasing in volume. Thus, the increase of pressure within chamber 60*c* acts upon the outer surface of semi-sealed package 22 and thereby decreases its internal volume, expelling air/gas from inside semi-sealed package 22 through the second open end of package 22. As illustrated by the arrows in FIG. 7B, the inner volume of semi-sealed package 22 decreases as air/gas is expelled along the direction of the arrows from semi-sealed package 22 towards the open end of the package and into tubular film 21. Thus, film 21 conforms more closely to the shape of product 20.

Figure 7C:
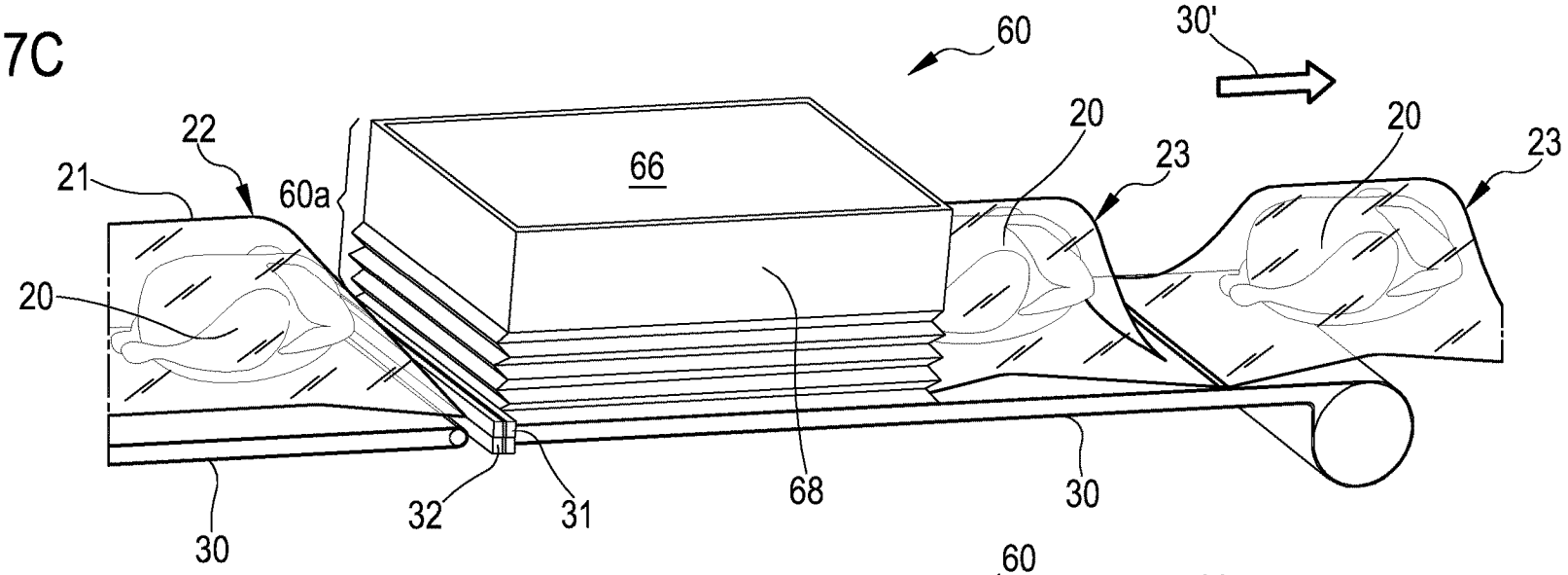

Upon completion of air/gas expulsion, as shown in FIG. 7C, control unit 50 is configured to control sealing and cutting members 31 and 32 so as to provide film 21 with corresponding seals and (optionally) to cut package 23, which is now sealed at both ends, from tubular film 21, which has been once again formed into a semi-sealed package 22. Subsequently, sealing and cutting members 31 and 32 are controlled to release film 21 in order to allow for further transportation of packages 23 and 22.

Figure 7D:
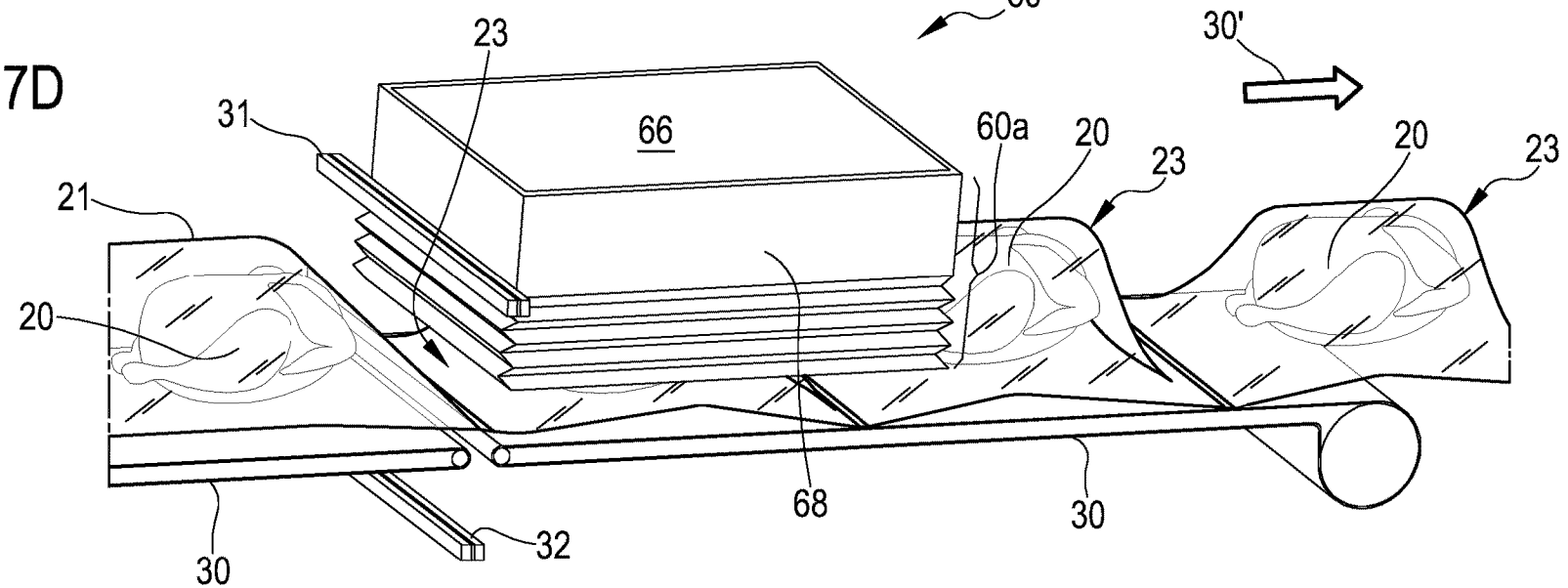

As shown in FIG. 7D, control unit 50 is then configured to control actuator 62 (not shown) to move head 60*a* and support 60*b* (e.g. means for moving 30) into a spaced-apart configuration, thereby facilitating removal (e.g. further transportation by means for moving 30) of package 23 away from below head 60*a* and arrangement of a subsequent semi-sealed package 22 in correspondence of the working portion 60*b*' of support 60*b* (not shown; see FIGS. 1 and 4A to 4D for reference). After a subsequent semi-sealed package 22 has been arranged in correspondence of the working portion 60*b*' of support 60*b*, the process starts again as described above with respect to FIG. 7A and following. In the third embodiment, apron 68 having bellows 65 can accommodate the compression as well as conform to packages 22 and 23 in order to provide chamber 60*c* with a substantially sealed contact to support 60*b*, film 21, and/or packages 22 and 23, so that the increase in pressure within chamber 60*c* can be achieved.

Figure 8A:
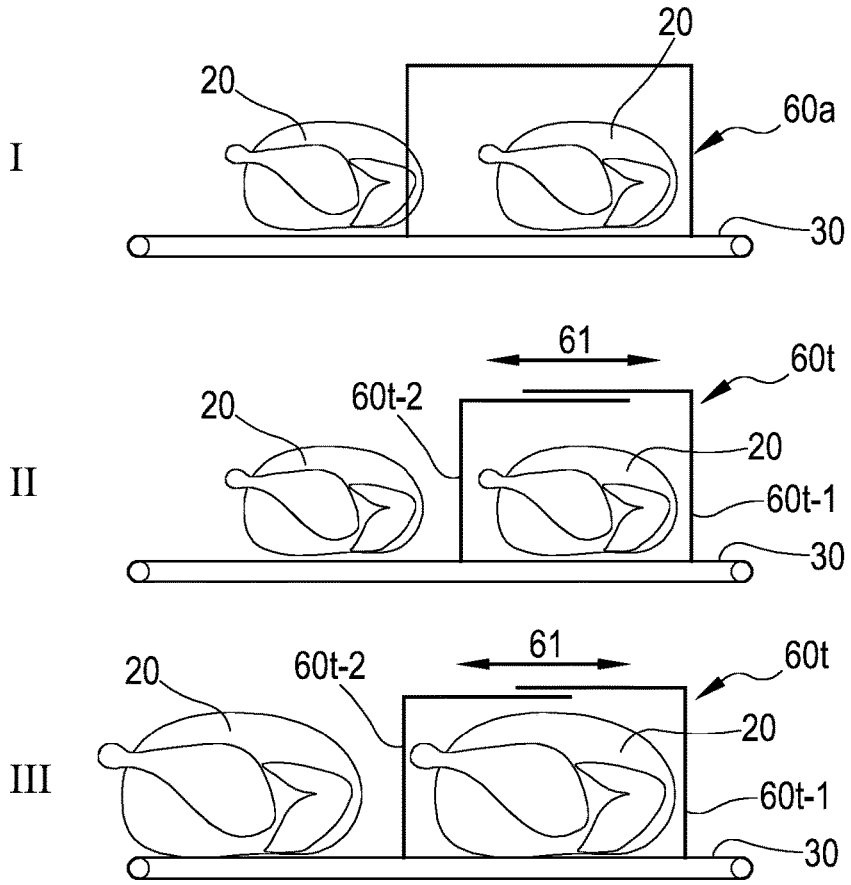
FIG. 8A shows a comparison of three packaging lines, in which sub-figure I illustrates an evacuation assembly having a head of fixed size and in which sub-figures II and III illustrate an evacuation assembly having a head of adjustable size.

FIG. 8A shows a comparison of three packaging lines, in which sub-figure I illustrates an evacuation assembly having a head of fixed size and in which sub-figures II and III illustrate an evacuation assembly having a head of adjustable size. Movement of products 20 along the packaging apparatus is from right to left in FIG. 8A. The packaging line shown in FIG. 8A-I illustrates an evacuation assembly having a head 60*a* of fixed size. Typically, products 20 of a certain are placed on means for moving 30 in a respective distance from one another such that a packaging film (not shown) can be used in an efficient manner, for example without necessitating too much material at both ends where the film is sealed. Further, the size of the products 20 to be packaged may change over time. Depending upon the size and/or placement of products 20, therefore, head 60*a* may not only cover one product, but also extend into a region of placement of a preceding (or subsequent) product 20. As detailed above, head 60*a* comprises a deformable portion or apron 68 that can accommodate the preceding (or subsequent) product 20 in that the apron 68 sealingly adapts to the shape thereof and ensures that the increase in pressure within chamber 60*c* can be achieved (see description of FIGS. 7A to 7D above). As a result, the dimensions of head 60*a* need to be selected such that it can be ensured that a maximum product size can be accommodated while at the same time avoiding that products 20 have to be placed too far from one another (e.g. resulting in inefficient use of packaging film). In general, the adjustment direction 61 substantially corresponds to a direction of movement of the products 20 along packaging apparatus 1 (i.e. longitudinal adjustment). In some embodiments, however, the adjustment direction can be different from the movement direction. For example, the adjustment direction can be substantially perpendicular to the movement direction in order to accommodate products of different width (i.e. lateral adjustment). In other embodiments, the head can be adjusted both longitudinally and laterally.

In accordance with a fourth embodiment of the present invention, evacuation assembly 60 is provided with an adjustable head 60*t* comprising relatively movable parts 60*t*-1 and 60*t*-2. At least one of parts 60*t*-1 and 60*t*-2 is movable with respect to the other (or both with respect to one another) in an adjustment direction 61. As can be seen in FIG. 8A-II, part 60*t*-2 has been moved towards part 60*t*-1 in order to more closely enclose product 20 placed within head 60*t* and/or in order to avoid any interference with preceding product 20 (on the left of head 60*t*). Similarly, as can be seen in FIG. 8A-III, part 60*t*-2 can also be moved away from part 60*t*-1 in order to more accommodate a larger product 20 placed within head 60*t*, while still avoiding any interference with preceding product 20 (on the left of head 60*t*). In this manner, the size of head 60*t* can be adapted depending upon size and/or placement of products 20 in order to ensure efficient evacuation.

Figure 8B:
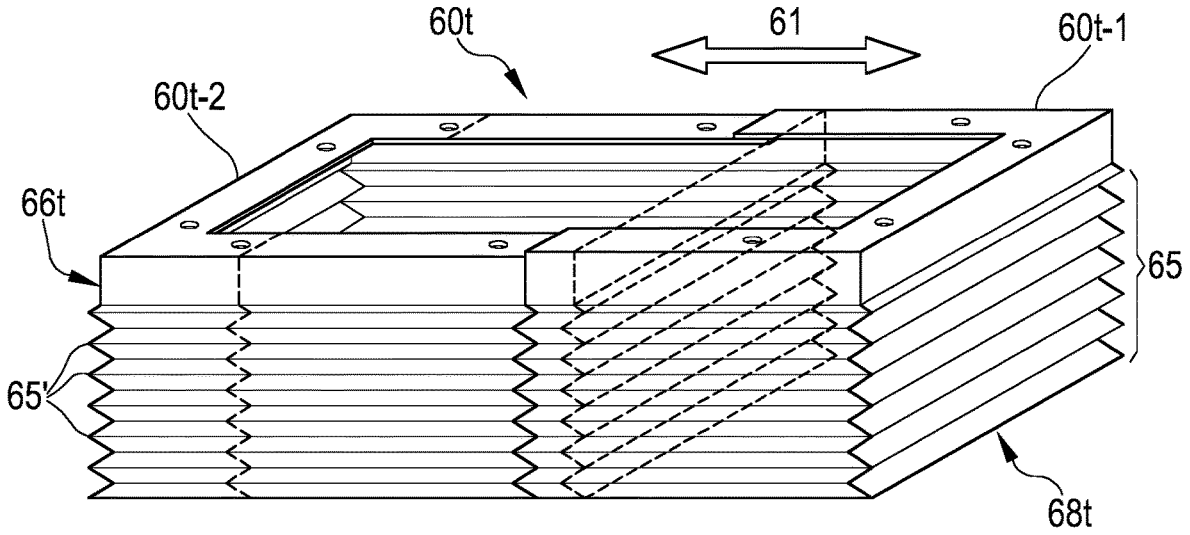
FIG. 8B schematically shows an isometric view of a head of an evacuation assembly in accordance with a fourth embodiment of the present invention.

FIG. 8B schematically shows an isometric view of a head 60*t* of an evacuation assembly in accordance with the fourth embodiment of the present invention. Head 60*t* in accordance with the fourth embodiment is provided with parts 60*t*-1 and 60*t*-2 provided in a telescopic arrangement in which at least one of parts 60*t*-1 and 60*t*-2 is movable with respect to the other (or both with respect to one another) in the adjustment direction 61. Head 60*t* has a holder 66*t* comprising corresponding telescopic holder parts that facilitate the relative movement of parts 60*t*-1 and/or 60*t*-2. Here, the parts of holder 66*t* are configured for telescopic adjustment (e.g. relative sliding of at least one part with respect to the other) so that the holder parts as well as corresponding parts of apron 68*t* can be adjusted in a telescopic manner, corresponding parts sliding along and overlapping with their counterparts. Head 60*t* has an apron 68*t* comprising a bellows 65 and folds 65'. As shown, similar to holder parts sliding and overlapping with respect to one another, parts of apron 68*t* are also sliding alongside one another and overlap with each other. Corresponding parts of apron 68*t* slidingly engage one another in substantially the same manner as corresponding parts of holder 66*t*, thus ensuring substantially air or gas tight contact therebetween. Flow regulators (not shown) can be integrated into the apron and/or holder in substantially the same manner as discussed above with respect to the first, second, or third embodiment. it is noted that one or more flow regulators can be integrated into either part of head 60*t*, for example in the apron 68*t* and/or in the holder 66*t*.

It is further noted that the fourth embodiment has been illustrated having a bellows-type apron 68*t*. However, the telescopic adjustment of head 60*t* can be combined with other types of aprons and can, for example, be provided with an apron substantially corresponding to that of the first embodiment (see, e.g., FIG. 2, 3, or 5). In this case, parts of apron 68*t* can either be provided in a slidable configuration as described above with respect to the fourth embodiment. Alternatively, apron 68*t* can be made from a compliant material configured to accommodate an adjustment of parts of holder 66*t* by deformation. For example, opposite sidewalls of apron 68*t* can be configured to stretch and contract depending upon the configuration of holder 66*t*, while being slidably held in a guide (e.g. a guide of the dovetail type).

In a variant of the fourth embodiment, the telescopic adjustment of head 60*t* comprises adjusting merely the position of the downstream wall. In a manner substantially corresponding to what is described above with respect to FIGS. 8A and 8B, the downstream wall of head 60*t* is provided with an adjustment corresponding to parts 60*t*-1 or 60*t*-2 described, which allows selectively adjusting the distance of the downstream wall with respect to the upstream wall. To this aim, the downstream wall may comprise a gasket or seal along a contact area with remaining walls of head 60*t* such that independently from the adjustment of the downstream wall, compression of portion 68*t* can be performed and a pressure increase within the chamber can be achieved as described above with respect to portion 68 and chamber 60*c*.

Packaging apparatus 1 may comprise an HFFS machine. The HFFS machine may comprise a conveyor belt 30 for supporting and transporting the packages 22, in a horizontal direction. Product 20 may be within a package. The package 22 is unsealed when the gas is expelled from the package. The packaging may comprise a film 21. For example, the product 20 may be wrapped or partially wrapped in a film 21. The film 21 extends around the product 20. Gas is enclosed with the product 20 by the film 21. Product 20 may be disposed on a surface. The surface may extend substantially in the horizontal direction. The surface may comprise the upper surface of a conveyor belt 30. The conveyor belt 30 may be a continuous conveyor belt 30. For example, the conveyor belt 30 may be suspended between at least two rollers. The conveyor belt 30 may transport the product 20 in a horizontal direction. Product 20 may be disposed in a tray. The tray supports the product 20. The tray may comprise walls that extend substantially vertically from the base of the tray to a height greater than the vertical dimension of the product 20. Alternatively, the tray height may be less than or equal to the height of the product 20. The packaging extends around the tray. The tray may comprise a material selected from a list consisting of polystyrene, Aluminium, or other thermoplastic material such as PET, or cardboard. The tray may be rigid, solid or foamed, and have any color and shape.

The packaging material may comprise a multi-layer film 21. Film 21 may comprise a polyolefin. The film 21 may be a fully coextruded shrinkable film 21. Package 23 provides a barrier to gas passing between the interior of the package 23 to the exterior of the package. Accordingly, the environment inside the package 23 is isolated from the environment outside the package. This helps to preserve food products 20 and avoid contamination. This may be advantageous with respect to food hygiene. Package 23 may provide a barrier to aromas or to gasses. This may be particularly useful when the product 20 is a food product 20. The package 23 may be abuse-resistant. The packaging material may be transparent or translucent. This may allows a customer to see the product 20 through the packaging. For example, the packaging may comprise a transparent film 21. The packaging film may be anti-fog. This ensures high consumer appeal. The packaging film may be printable. This allows labels to be printed directly onto the packaging. The packaging may be formed from a roll of film 21. Tubular film 21 may be created by forming a tube from the roll of film 21. Packaging apparatus 1 may comprise a former configured to form the roll of film 21 into a tube. The former may form the tube by forming a longitudinal seal along the longitudinal edges of the roll of film 21. The tube may be formed from two webs of film 21. In this case, the former forms two longitudinal seals along the opposing edges of the two rolls of film 21.

Packaging apparatus 1 may comprise a flusher 34. Flusher 34 may be configured to flush gas through the tube of film 21 that forms the packaging. The gas flush prevents the tube from collapsing. The gas flush helps to maintain a distance between a product 20 in a tray and the film 21. This helps to improve the hygienic appearance of the film 21 because the film 21 remains untarnished by the product 20. Flusher 34 flushes gas longitudinally through the tube. The gas used for flushing may comprise about 70% oxygen and about 30% carbon dioxide or other suitably modified atmosphere. Additionally, the gas flush may allow the product 20 to be packaged in a modified atmosphere. The gas may help to preserve the product 20, prolonging its shelf life. The desired amount of gas inside each sealed package 23 depends on the type of product 20 and the length of shelf life needed.

Packaging apparatus 1 may comprise a shrinking machine configured to shrink film 21. The shrinking machine may be, for example a shrink tunnel 33, or a hot air tunnel 33. Sealed package 23 may be shrunk in the shrinking machine. The shrinking process may involve heating the sealed package. The package 23 may be heated to a temperature within the range of from about 130° C. to about 150° C. Before sealed package 23 is shrunk, there may be undesirable gas trapped in sealed package 23 along with the product 20. After shrinking, package 23 is referred to as package 23' (see, e.g., FIG. 1), indicating that heat-shrinking has taken place.

Product 20 may be a food product. For example, product 20 may comprise meat, cheese, pizza, ready meals, poultry and fish. Product 20 may be substantially dry, as in the case of cheese. For some products, such as cheese, there is no need for a tray to support the cheese. Alternatively, product 20 may be wet. In this case, it is particularly desirable for product 20 to be disposed in a tray. The packaging process of the invention may be employed to package food products 20 that are to have a shelf life in the region of, for example, from about six days to about 14 days.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and the scope of the appended claims.

The invention claimed is:

1. A packaging apparatus comprising:

a control unit;

a loading station configured to position a tubular film around a product to be packaged;

a sealing station coupled to the control unit, the control unit being configured to control the sealing station to create one or more seals on the tubular film;

an evacuation assembly coupled to the control unit, the evacuation assembly including a first member and a second member arranged opposite the first member, the first member including a holder portion and a deformable portion, the deformable portion being coupled to the holder portion and facing the second member, and wherein the deformable portion is in the form of an apron coupled to the holder portion, the first and second members being relatively movable between:

a first configuration, in which the first and second members are spaced apart from one another, a second configuration, in which the deformable portion contacts one or more of at least part of the second member or part of the tubular film which in use is resting against the second member, and a third configuration in which the deformable portion is compressed in a compression direction towards the second member; and a conveyor configured to move the product relative to and from the evacuation assembly;

wherein the deformable portion delimits a chamber having an opening towards the second member; and wherein the apron defines the side wall of said chamber.

2. The packaging apparatus of claim 1, wherein:

when the first and second members are in the second or third configuration, the chamber is closed against the second member and defines a working portion on the second member, the perimeter of which is configured to encompass a product positioned in a package and placed in correspondence of the working portion.

3. The packaging apparatus of claim 2, wherein:

when the first and second members are in the second configuration, the holder portion and the second member are positioned at a first distance from one another, providing the chamber with a first internal volume; and when the first and second members are in the third configuration, the holder portion and the second member are positioned at a second distance, smaller than the first distance, from one another, providing the chamber with a second internal volume smaller than the first internal volume.

4. The packaging apparatus of claim 1, wherein at least 30% of the entire vertical extension of the apron is made in a deformable material or in a deformable structure.

5. The packaging apparatus of claim 1, wherein the deformable portion comprises a deformable region, the deformable region having a bellows-type structure extending circumferentially along the deformable portion.

6. The packaging apparatus of claim 1, wherein the deformable region comprises one or more of: rubber; fabric; cardboard; composite material including rubber and fabric and/or cardboard; deformable plastic; LLDPE; PLA; PA; Teflon; LLDPE, PLA, or PA including an additive.

7. The packaging apparatus of claim 1, wherein the deformable portion comprises an outer portion and an inner portion, and wherein at least one of the outer portion or the inner portion has the form of a layer of film material.

8. The packaging apparatus of claim 7, wherein the outer portion comprises one or more flow regulators, the one or more flow regulators being configured to allow the passage of air or gas, and wherein the one or more flow regulators are configured to allow the passage of air or gas when a pressure differential between opposite sides of the outer portion reaches or exceeds a pre-determined maximum value, the maximum value ranging from 1 kPa to 50 kPa (0.01 bar to 0.50 bar).

9. The packaging apparatus of claim 1, further comprising at least one of:

an output station, wherein the control unit is coupled to the output station and configured to control an output of one or more sealed packages from the packaging apparatus;

a flusher (34), wherein the control unit is coupled to the flusher and configured to control the flusher to provide one or more of the inside of the tubular film or the inside of a semi-sealed package with one of an inert gas, a mixture of inert gases, or a modified atmosphere; or a shrink station, wherein the control unit is coupled to the shrink station and configured to control the shrink station to heat-shrink one or more sealed packages.

10. A packaging apparatus comprising:

a control unit;

a loading station configured to position a tubular film around a product to be packaged;

a sealing station coupled to the control unit, the control unit being configured to control the sealing station to create one or more seals on the tubular film;

an evacuation assembly coupled to the control unit, the evacuation assembly including a first member and a second member arranged opposite the first member, the first member including a deformable portion, the first and second members being relatively movable between:

a first configuration, in which the first and second members are spaced apart from one another, a second configuration, in which the deformable portion contacts one or more of at least part of the second member or part of the tubular film which in use is resting against the second member, and a third configuration in which the deformable portion is compressed in a compression direction towards the second member; and a conveyor configured to move the product relative to and from the evacuation assembly;

wherein the first member consists of a first part and a second part, at least one of the first and second parts being relatively movable with respect to the other.

11. The packaging apparatus of claim 10, wherein at least one of the first and second parts is relatively movable with respect to the other along an adjustment direction extending substantially parallel to a motion direction of products along the packaging machine.

12. The packaging apparatus of claim 10, wherein:

the first part and the second part are configured to slidably engage one another, thereby allowing the relative movement to adjust a size of the first member; and relative movement of the first part and the second part determines the size of the working portion.

* * * * *